US006749714B1

(12) United States Patent
Ishikawa et al.

(10) Patent No.: US 6,749,714 B1
(45) Date of Patent: Jun. 15, 2004

(54) POLISHING BODY, POLISHER, POLISHING METHOD, AND METHOD FOR PRODUCING SEMICONDUCTOR DEVICE

(75) Inventors: Akira Ishikawa, Kawasaki (JP); Tatsuya Senga, Kawasaki (JP)

(73) Assignee: Nikon Corporation, Tokyo (JP)

( * ) Notice: Subject to any disclaimer, the term of this patent is extended or adjusted under 35 U.S.C. 154(b) by 0 days.

(21) Appl. No.: 09/856,272

(22) PCT Filed: Mar. 14, 2000

(86) PCT No.: PCT/JP00/01544

§ 371 (c)(1),
(2), (4) Date: May 18, 2001

(87) PCT Pub. No.: WO00/59680

PCT Pub. Date: Oct. 12, 2000

(30) Foreign Application Priority Data

| | | |
|---|---|---|
| Mar. 30, 1999 | (JP) | 11/88157 |
| Apr. 5, 1999 | (JP) | 11/98179 |
| Sep. 8, 1999 | (JP) | 11/254941 |
| Feb. 2, 2000 | (JP) | 2000/25373 |
| Feb. 2, 2000 | (JP) | 2000/25386 |

(51) Int. Cl.[7] ..... B24B 37/00
(52) U.S. Cl. ..... 156/345.12
(58) Field of Search ..... 156/345.12

(56) References Cited

U.S. PATENT DOCUMENTS

| | | | | |
|---|---|---|---|---|
| 5,489,233 A | * | 2/1996 | Cook et al. | 451/41 |
| 5,605,760 A | | 2/1997 | Roberts | 428/409 |
| 5,876,269 A | | 3/1999 | Torii | 451/41 |
| 5,958,794 A | * | 9/1999 | Bruxvoort et al. | 438/692 |
| 6,224,465 B1 | * | 5/2001 | Meyer | 451/41 |
| 6,296,557 B1 | * | 10/2001 | Walker | 451/526 |

FOREIGN PATENT DOCUMENTS

| | | |
|---|---|---|
| EP | 0 845 328 | 6/1998 |
| JP | 61-19560 | 1/1986 |
| JP | 7-52033 | 2/1995 |
| JP | 8-11051 | 1/1996 |
| JP | 8-132342 | 5/1996 |
| JP | 9-11119 | 1/1997 |
| JP | 9-150361 | 6/1997 |
| JP | 2770721 B2 | 4/1998 |
| JP | 10-118918 | 5/1998 |
| JP | 10-125634 | 5/1998 |
| JP | 11-48129 | 2/1999 |
| JP | 2000-263423 | 9/2000 |
| TW | 365561 | 8/1999 |

* cited by examiner

*Primary Examiner*—Gregory Mills
*Assistant Examiner*—Sylvia R. MacArthur
(74) *Attorney, Agent, or Firm*—Morgan, Lewis & Bockius LLP

(57) ABSTRACT

The present invention provides a hard polishing pad consisting of a non-foam material which is used in a CMP apparatus. Hard polishing pads consisting of foam resins show good pattern step difference elimination, but tend to cause scratching of the wafer. Furthermore, the polishing rate tends to be lower than that of polishing pads consisting of foam polyurethane. In the polishing pad of the present invention, spiral grooves or concentric circular grooves and lattice-form grooves are combined in the surface of the polishing pad; furthermore, the angles of intersection of the grooves are set at less than 2 degrees, and there are no edge parts with a curvature radius of 50 nm or less in the surface of the polishing pad. Accordingly, since there is no generation of flash, the object of polishing is not scratched, and the polishing rate can be increased.

12 Claims, 20 Drawing Sheets

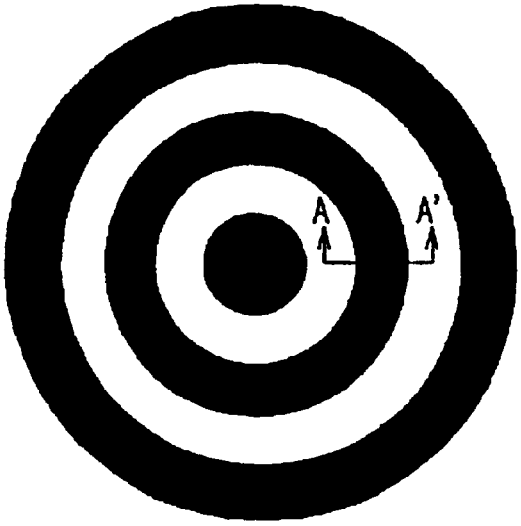
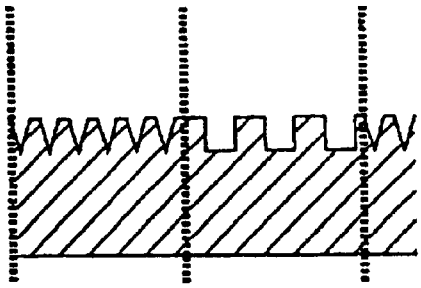
FIG. 21A FIG. 21B
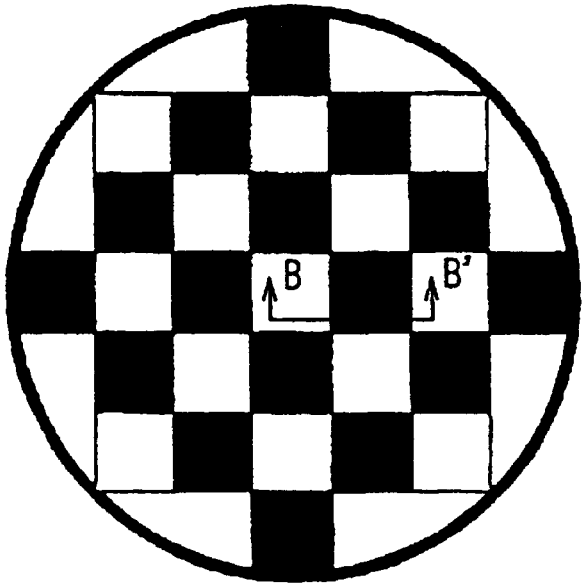
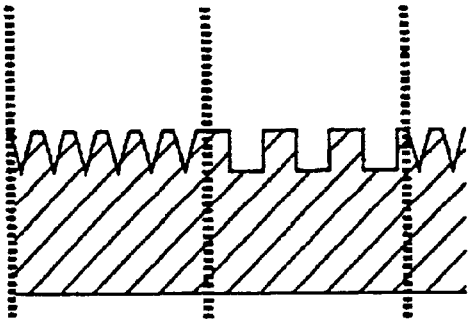
FIG. 22A FIG. 22B

POLISHING BODY, POLISHER, POLISHING METHOD, AND METHOD FOR PRODUCING SEMICONDUCTOR DEVICE

This application is filed under 35 U.S.C. §371 from International Application PCT/JP00/01544, with an international filing date of Mar. 14, 2000, which claims the benefit of priority to Japanese Application Nos.: 11-88157, filed Mar. 30, 1999; 11-98179, filed Apr. 5, 1999; 11-254941, filed Sep. 8, 1999; 2000-25373, filed Feb. 2, 2000; and, 2000-25386, filed Feb. 2, 2000, which are incorporated by reference in their entirety.

BACKGROUND OF THE INVENTION

1. Field of the Invention

The present invention relates to a polishing body used in a polishing apparatus which is suitable for use in planarization polishing, etc., of semiconductor devices such as ULSI devices, etc., performed in processes in which such semiconductor devices are manufactured, a polishing apparatus and a polishing method, and further relates to a semiconductor device manufacturing method using the above-mentioned polishing apparatus and polishing method.

2. Discussion of the Related Art

As semiconductor integrated circuits have become finer and more highly integrated, the individual processes involved in semiconductor manufacturing processes have become more numerous and complicated. As a result, the surfaces of semiconductor devices are not always flat. The presence of step differences on the surfaces of semiconductor devices leads to step breakage of wiring and local increases in resistance, etc., and thus causes wiring interruptions and drops in electrical capacitance. In insulating films, furthermore, such step differences also lead to a deterioration in the withstand voltage and the occurrence of leaks.

Meanwhile, as semiconductor integrated circuits have become finer and more highly integrated, the wavelengths of light sources in semiconductor exposure apparatuses used in photolithography have become shorter, and the numerical aperture or so-called NA of the projection lenses used in such semiconductor exposure apparatuses has become larger. As a result, the focal depth of the projection lenses used in such semiconductor exposure apparatuses has become substantially shallower. In order to deal with such increasing shallowness of the focal depth, there is a demand for even greater planarization of the surfaces of semiconductor devices than that achieved so far.

To describe this in concrete terms, planarization techniques such as that shown in FIG. 1 have become essential in semiconductor manufacturing processes. FIG. 1 is a schematic diagram illustrating planarization techniques used in a semiconductor manufacturing process, and shows sectional views of a semiconductor device. In FIG. 1, 11 indicates a silicon wafer, 12 indicates an inter-layer insulating film comprising $SiO_2$, 13 indicates a metal film comprising Al, and 14 indicates the semiconductor device.

FIG. 1A shows an example of the planarization of an inter-layer insulating film 12 on the surface of the semiconductor device. FIG. 1B shows an example in which a so-called damascene is formed by polishing a metal film 13 on the surface of the semiconductor device. A chemical mechanical polishing or chemical mechanical planarization (hereafter referred to as "CMP") technique is widely used as a method for planarizing the surfaces of such semiconductor devices. Currently, the CMP technique is the sole method that can be used to planarize the entire surface of a silicon wafer.

CMP was developed on the basis of silicon wafer mirror surface polishing methods, and is performed using a CMP apparatus of the type shown in FIG. 2. In FIG. 2, 15 indicates a polishing member, 16 indicates a member that holds the object of polishing (hereafter referred to as a "polishing head" in some instances), 17 indicates a silicon wafer which is the object of polishing, 18 indicates a polishing agent supply part, and 19 indicates a polishing agent. The polishing member 15 has a polishing body 21 (hereafter referred to as a "polishing pad" in some instances) which is attached to the surface of a polishing platen 20. A sheet-form foam polyurethane is widely used as such a polishing body 21.

The object of polishing 17 is held by the polishing head 16, so that it is caused to oscillate while being rotated, and is pressed against the polishing body 21 of the polishing member 15 with a specified pressure. The polishing member 15 is also rotated, so that a relative motion is performed between the polishing member 15 and the object of polishing 17. In this state, the polishing agent 19 is supplied to the surface of the polishing body 21 from the polishing agent supply part 18. The polishing agent 19 diffuses over the surface of the polishing body 21, and enters the space between the polishing body 21 and the object of polishing 17 as the polishing member 15 and object of polishing 17 move relative to each other, so that the surface of the object of polishing 17 that is to be polished is polished. Specifically, good polishing is accomplished by a synergistic effect of the mechanical polishing caused by the relative motion of the polishing member 15 and object of polishing 17 and the chemical action of the polishing agent 19.

In cases where a sheet-form polishing pad comprising a conventional foam resin (hereafter referred to as a "foam polishing pad") is used, the uniformity of the polishing over the entire surface of the wafer is good. However, foam polishing pads generally suffer from the following problems:

(1) The edge sloping that occurs in polishing is great.

(2) When a load is applied, the pads undergo compressive deformation.

As a result of these problems, foam polishing pads have not shown good step difference elimination characteristics, i.e., good polishing smoothness, in the case of patterned wafers. Recently, therefore, polishing pads comprising harder non-foam resins (hereafter referred to as "non-foam polishing pads" in some instances) have been investigated.

In non-foam polishing pads, indentations and projections comprising a groove structure are formed in the surface of a hard macromolecular polymer, and these indentations and projections polish the surface of the object of polishing (in this case, a wafer). The use of a non-foam polishing pad solves the problem of poor step difference elimination characteristics encountered in cases where foam polishing pads are used.

In regard to the process stability of a CMP apparatus, an absence of scratches is required from the standpoint of avoiding wiring interruption and insulation breakdown of the device, in addition to the requirement for stable uniformity and smoothness even when the number of wafers treated by the polishing pad is increased.

However, although hard polishing pads comprising non-foam resins show good pattern step difference elimination, such pads tend to cause scratching of the wafer; furthermore, the polishing rate tends to be lower than that of polishing pads comprising a foam polyurethane.

Furthermore, other important factors that generally determine the polishing rate of a polishing pad include the retention and fluidity of the polishing agent on the surface of the polishing pad. In terms of retention of the polishing agent, hard non-foam polishing pads cannot match foam polishing pads. Furthermore, in cases where conventional non-foam polishing pads are fastened to the surface of a platen, and this platen is rotated at a high speed while the polishing agent is supplied, the polishing agent is caused to fly off the polishing pad by centrifugal force, so that the polishing agent retention is low. Accordingly, there is a problem in that the polishing agent that is supplied does not effectively contribute to an increase in the polishing rate.

Meanwhile, the most commonly used polishing body in conventional processes is a polishing body (polishing pad) which chiefly comprises a foam polyurethane. Such a polishing body has a superior capacity for retaining the polishing agent on the surface of the polishing body. However, when such a polishing body is continuously used, the abrasive particles of the polishing agent clog the holes in the foam portion of the surface of the polishing body, so that there are large fluctuations in the polishing rate. Accordingly, an operation known as "dressing", in which the surface of the polishing body is ground away by means of a grinding wheel on which diamonds have been electrodeposited must be performed before polishing and during polishing, so that the surface conditions of the polishing body always remain the same.

Furthermore, like the above-mentioned foam polishing bodies, fixed abrasive particle type polishing bodies in which polishing abrasive particles are contained in a resin also require dressing in order to handle clogging of the holes in the foam portion by abrasive particles and in order to keep the state of the polishing abrasive particles uniform.

In regard to the polished silicon wafer (object of polishing), the polishing characteristics of uniformity and smoothness are extremely important.

"Uniformity" is used to evaluate how uniformly polishing is performed over the entire area of the silicon wafer. The following formula is generally used for this evaluation:

$$\text{Uniformity } (\%)=(RA-RI)/(RA+RI)\times 100$$

Here, RA is the maximum amount of polishing in the measured polishing amount profile, and RI is the minimum amount of polishing in the measured polishing amount profile. In the case of the uniformity value obtained from the above formula, a smaller value indicates better characteristics. Specifically, the uniformity of polishing over the entire surface of the silicon wafer increases with a decrease in the difference between the maximum amount of polishing and the minimum amount of polishing.

Furthermore, "smoothness" is used to evaluate the magnitude of the residual step difference when a pattern with indentations and projections is polished. In other words, in a patterned silicon wafer with step differences, this value indicates the extent to which projecting parts of the patterned silicon wafer are selectively polished away by polishing, so that the residual step differences following polishing are reduced.

Both of these polishing characteristics of uniformity and smoothness are very greatly influenced by the elastic modulus of the polishing body. Polishing bodies are classified according to the size of their elastic modulus into soft polishing bodies which have a small elastic modulus and hard polishing bodies which have a large elastic modulus.

In the case of soft polishing bodies, the adhesion of the surface of the polishing body to warping of the silicon wafer is extremely high when pressure is applied to the silicon wafer, so that the uniformity is extremely good over the entire surface of the silicon wafer. However, in the case of silicon wafers with recessed and projecting patterns, the polishing body conforms to the indentations and projections in the surface of the silicon wafer as a result of the deformation of the polishing body, so that polishing proceeds with the step differences remaining unchanged. As a result, the smoothness is poor.

On the other hand, in the case of hard polishing bodies with a large elastic modulus, the deformation of the polishing body with respect to silicon wafers that have an recessed and projecting pattern is small, so that polishing proceeds in order from the projecting portions of the recessed and projecting pattern; as a result, the smoothness is good. However, since the warping of the silicon wafer and the pressure distribution during pressure application have a direct effect on the polishing, the uniformity is poor.

However, even in cases where the same material is used for the polishing body, the thickness of the polishing body and structural factors of the polishing body such as the width and depth of the grooves in the surface of the polishing body have a great effect as variations in the apparent elasticity. Specifically, as the thickness of the polishing body increases, the amount of elastic deformation of the polishing body increases, so that the polishing body becomes softer in apparent terms. On the other hand, in the case of a thin polishing body, the amount of deformation is small, so that the polishing body is hard in apparent terms. Furthermore, in terms of the groove structure as well, a polishing body in which the depth of the grooves is deep and the width of the projection portions between the grooves is narrow shows a large deformation of the surface when the load is applied, so that such a polishing body is soft in apparent terms. On the other hand, a polishing body in which the depth of the grooves is shallow and the width of the projecting portions between the grooves is wide shows little deformation when the load is applied, so that such a polishing body is hard in apparent terms.

In the above description, the thickness and groove structure of the polishing body were described from the standpoint of elasticity. Besides this, another important role played by the grooves is the stable supply of the polishing agent. In regard to groove structures for achieving such a stable supply of the polishing agent, groove patterns of various shapes have been disclosed in the past. If the supply of the polishing agent that is accomplished by means of these grooves is insufficient, the polishing agent that is supplied to the surface of the object of polishing that is being polished will be insufficient, so that the mechanical polishing and the chemical reaction that occurs during polishing are insufficient. As a result, the polishing rate drops. Furthermore, the temperature conditions resulting from the friction between the polishing body and the surface of the object of polishing that is being polished are also non-uniform, so that there is a conspicuous drop in the uniformity of the polishing; moreover, such a problem also leads to scratching of the surface of the object of polishing and vibration of the polishing head and polishing platen during polishing, etc.

Polishing apparatuses used to perform CMP include various types of apparatuses based on different concepts and with different special features. For example, such apparatuses include apparatuses in which a plurality of silicon wafers are simultaneously polished by means of a single polishing body in order to increase the throughput, apparatuses in which polishing is performed by high-speed rotation using a polishing body that is smaller than the silicon wafer in order to reduce the size of the apparatus, and apparatuses in which the polishing head part is specially modified in order to improve the uniformity, etc. Such diversity of polishing apparatuses has an inseparable relationship with the optimal groove structure for a stable supply of the polishing agent, and such a stable supply of the polishing agent to the polishing surface depends largely on the apparatus that is used.

In CMP, the polishing working time is extremely short compared to that of other types of polishing such as optical polishing or metal lapping, etc. Specifically, polishing is performed under conditions in which the rotation and application of pressure, etc., during polishing are extremely great. Accordingly, polishing is performed under conditions in which retention of the polishing agent on the surface of the polishing body is difficult.

In regard to the groove structure that is considered optimal, the above-mentioned dependence on the apparatus may be cited; basically, however, what is important is how the polishing agent should be retained on the surface of the polishing body during polishing.

However, in the case of conventional polishing bodies that chiefly comprises a foam polyurethane, and fixed abrasive particle type polishing bodies in which the polishing abrasive particles are contained in a resin, the surface of the polishing body is shaved away by dressing, so that the thickness of the polishing body gradually decreases. Accordingly, in a case where the polishing body is viewed as a single elastic body, since the thickness changes, the polishing body shows a continuous variation in the amount of elastic deformation accompanying this change in thickness, thus resulting in the problem of a large fluctuation in the uniformity and smoothness as the polishing body is used. Furthermore, not only does the thickness of the above-mentioned polishing body vary as a result of dressing, but there is also a change in the groove structure (depth of the grooves, etc.) in the surface of the polishing body. As a result, another problem arises: namely, the polishing characteristics cannot be controlled by means of the thickness and groove structure of the polishing body.

As was described above, an improvement in uniformity and an improvement in smoothness cannot both be achieved at the same time in either soft polishing bodies or hard polishing bodies; there is a tradeoff relationship between uniformity and smoothness.

Recently, polishing bodies which have a laminated structure in which two layers, i.e., a lower layer with a large elastic modulus and an upper layer with a small elastic modulus, are laminated have been used in order to satisfy both of the above-mentioned polishing requirements; furthermore, polishing heads with a fluid pressurization system, etc., in which the pressure application system of the polishing head is modified have been used with the aim of achieving both an improvement in uniformity and an improvement in smoothness.

However, in the case of polishing bodies with a laminated structure, there are great differences in the polishing characteristics due to variation in the polishing bodies themselves, so that the problem of an increase in unstable elements is encountered from the standpoint of semiconductor manufacturing processes. Furthermore, in cases where the polishing head is modified, the problem is that the structure of the polishing head becomes extremely complicated.

SUMMARY OF THE INVENTION

A first aspect of the present invention is to solve the above-mentioned problems, and more concretely, to provide a polishing body (polishing pad), polishing apparatus and polishing method in which scratching tends not to occur, and in which the polishing rate is high, and a semiconductor device manufacturing method using the above-mentioned polishing apparatus and polishing method.

A second aspect of the present invention is to solve the above-mentioned problems, and more concretely, to provide a non-foam polishing body (polishing pad) in which the supplied polishing agent contributes effectively to polishing, so that efficient polishing is possible with respect to the polishing agent supply, in which the retention and fluidity of the polishing agent are high, so that the polishing rate is high, in which there is little scratching, and which is superior in terms of step difference elimination, as well as a polishing apparatus and polishing method using the above-mentioned polishing body, and a semiconductor device manufacturing method in which the cost of the polishing process is reduced and a more efficient process is achieved as a result of the use of the above-mentioned polishing apparatus and polishing method, and in which semiconductor devices can therefore be manufactured at a lower cost than in conventional semiconductor device manufacturing methods.

A third aspect of the present invention is to solve the above-mentioned problems, and more concretely, to provide a polishing body in which the wear caused by use of the polishing body is extremely small, and there is little variation in the surface shape, so that the polishing body always has stable polishing characteristics, a polishing apparatus and polishing method using this polishing body, and a semiconductor device manufacturing method using this polishing apparatus and polishing method.

Furthermore, another aspect is to provide a polishing body in which the polishing characteristics of uniformity, smoothness and polishing rate of the object of polishing can be controlled, and a polishing apparatus using this polishing body.

A fourth aspect of the present invention is to solve the above-mentioned problems, and more concretely, to provide a polishing body (polishing pad) which shows superior characteristics in terms of both uniformity and smoothness even in a conventional polishing apparatus, a polishing apparatus and polishing method using this polishing body, and a semiconductor device manufacturing method using this polishing apparatus and polishing method.

A first embodiment of the present invention which is used in order to achieve the above-mentioned first aspect is a polishing body used in a polishing apparatus which is equipped with a polishing head that holds the object of polishing and a polishing body, and which polishes the object of polishing by causing relative motion between the polishing body and the object of polishing in a state in which a polishing agent is interposed between the polishing body and the object of polishing; the polishing body being characterized by the fact that at least the surface of the polishing body comprises a non-foam macromolecular polymer, a groove structure is formed in the surface, and the surface has no sharp edge parts.

First, as a result of investigating polishing pads themselves, it has been discovered that there are problems in the groove structure formed in the surfaces of hard polishing pads comprising non-foam resins. When this groove structure is formed, flash may be formed on the surface of the polishing pad. Such flash may also be stripped away during polishing. This flash causes scratching of the surface of the object of polishing, i.e., the wafer. Furthermore, it was also discovered that the slurry may aggregate with such flash acting as nuclei, and that the aggregated slurry may cause scratching of the wafer surface.

The present invention was devised on the basis of such findings. Specifically, since the polishing body of the present invention comprises a non-foam macromolecular polymer, this polishing body retains the advantages of polishing bodies that comprise the non-foam agents; in addition, however, since this polishing body has no sharp edge parts on its surface, no flash is generated when these edge parts are formed. Accordingly, there is no scratching of the surface of the wafer caused by flashes or aggregation of the slurry. Furthermore, the term "edge part" refers to the boundaries between indentations and projections formed on the surface, and the apices of projecting parts. Furthermore, as is clear from the above description, the term "sharp edge parts" refers to edge parts on which flash is generated during working, and which are sharp enough so that this flash is stripped away during polishing.

A second embodiment of the present invention which is used in order to achieve the first aspect is the first embodiment wherein the groove structure comprises a plurality of grooves which have a plurality of intersection points, and the angles at which the grooves cross at the intersection points do not include any sharp angles that are less than 2 degrees.

Grooves are ordinarily formed in the surface of a polishing body for the purpose of supplying the polishing agent to the space between the polishing body and the object of polishing, etc. As a result of further experiments, it has been discovered in the case of a polishing body using an ordinary non-foam macromolecular polymer, flash tends not to be generated during working if the angles of intersection of the groove are less than 2 degrees, and that even if flash is generated, there is little stripping of this flash during polishing, so that scratching of the object of polishing is greatly reduced, thus making such angles desirable. Accordingly, in the present invention, the angles of intersection at the intersection points of the grooves are limited to angles that are less than 2 degrees.

A third embodiment of the present invention which is used in order to achieve the first aspect is the first embodiment wherein the groove structure comprises a plurality of grooves that have a plurality of intersection points, and the groove portions do not have any edge parts with a curvature radius of less than 50 $\mu$m.

As a result of additional experiments, it has been discovered that if sharp portions with a curvature radius of less than 50 $\mu$m are present in the curved parts, intersection parts or corner parts of the grooves formed in the surface of the polishing body, flash is frequently generated in these portions during working, and this flash falls off during polishing. The present invention is based on this finding, and is characterized by the fact that there are no edge parts with a curvature radius of less than 50 $\mu$m in the groove areas.

A fourth embodiment of the present invention which is used in order to achieve the first aspect is any of the first through third embodiments wherein the groove structure comprises one of a combination of a spiral groove and radial grooves, a combination of concentric circular grooves and radial grooves, and lattice-form grooves.

In the case of such groove structures, the angle of intersection of the spiral groove and radial grooves, concentric circular grooves and radial grooves or lattice-form grooves with each other can be set at close to 90 degrees. Accordingly, the generation of flash in the areas of intersection of the grooves during working can be inhibited, and such flash can be prevented from falling off during polishing.

A fifth embodiment of the present invention which is used in order to achieve the first aspect is any of the first through fourth embodiments wherein the macromolecular polymer comprises at least one resin selected from a set comprising epoxy resins, acrylic resins, polyester resins, vinyl chloride resins, polycarbonate resins and non-foam urethane resins.

Such materials show little wear during polishing. Accordingly, in cases where such materials are used for the polishing body, the useful life of the polishing body is extended. Consequently, the frequency with which the polishing body is replaced can be lowered, so that polishing costs can be reduced.

A sixth embodiment of the present invention which is used in order to achieve the first aspect is a polishing method in which a polishing head which holds the object of polishing, and a polishing body in which at least the surface of the polishing body comprises a non-foam macromolecular polymer, are used, and the object of polishing is polished by causing relative motion between the polishing body and the object of polishing in a state in which a polishing agent is interposed between the polishing body and the object of polishing, wherein the polishing agent contains cerium oxide particles.

Generally, slurries containing silicon dioxide ($SiO_2$) are widely used as polishing agents in the CMP polishing of dielectric materials. Such slurries are superior in terms of stability, but tend to aggregate and form a glass. This aggregate forms on the surface of the polishing pad. In cases where the point at which the aggregate forms is located inside a groove, the aggregate does not cause scratching; however, in cases where the aggregate forms outside a groove, i.e., on a projecting part, this aggregate tends to cause scratching.

In contrast, a slurry containing cerium oxide readily disperses in water; furthermore, such a slurry can be washed away easily by means of water, and tends not to aggregate; accordingly, a slurry of this type is suitable for use on a hard polishing pad comprising a non-foam resin (hereafter referred to as a "non-foam polishing pad"). Accordingly, in the present invention, a polishing pad in which at least the surface of the pad comprises a non-foam macromolecular polymer is used as the polishing body, and a slurry containing cerium oxide particles is used as the polishing agent; as a result, the occurrence of cracking caused by the polishing agent can be prevented to a greater extent than in possible in polishing agents containing silicon dioxide.

In cases where a slurry of cerium oxide is used with a foam polishing pad, the force retaining the slurry in the foam of the working surface of the polishing pad is high, so that an excessive quantity of cerium abrasive particles remains, thus affecting the stability of the polishing. Specifically, in such cases, the problem of a variation in the polishing rate over time and the problem of a slow response with respect to the control of the slurry supply have been encountered. In contrast, the non-foam polishing pad used in the present invention has a low retention force, and does not drag out the effects of previous states; accordingly, the control of the slurry concentration is immediately reflected in the polishing characteristics, especially the polishing rate, so that stable polishing characteristics can be maintained.

Furthermore, in cases where a non-foam polishing pad and a silicon oxide slurry are combined, it is difficult to increase the polishing rate; however, a high polishing rate can be obtained by combining such a polishing pad with a cerium oxide slurry. Furthermore, in regard to the size of the cerium oxide particles, particles that are easily obtainable may ordinarily be used; generally, the particle size is 200 nm or smaller.

A seventh embodiment of the present invention which is used in order to achieve the first aspect is a polishing method in which a polishing head which holds the object of polishing, and a polishing body in which at least the surface of the polishing body comprises a non-foam macromolecular polymer, are used, and the object of polishing is polished by causing relative motion between the polishing body and the object of polishing in a state in which a polishing agent is interposed between the polishing body and the object of polishing, wherein the polishing agent contains cerium oxide particles, and the polishing body is the polishing body of any of the first through fifth embodiments.

In this invention, the effect whereby the polishing pad itself tends not to form flash, and the effect whereby the polishing agent does not cause scratching act in a synergistic manner, so that the effect that prevents scratching of the object of polishing during polishing is heightened.

An eighth embodiment of the present invention which is used in order to achieve the first aspect of the first embodiment is a polishing method in which a polishing head which holds the object of polishing, and a polishing body, are used, and the object of polishing is polished by causing relative motion between the polishing body and the object of polishing in a state in which a polishing agent is interposed between the polishing body and the object of polishing, wherein the method has a stage in which a load is gradually applied between the object of polishing and the polishing body.

Accordingly, in cases where a fixed load is applied between the object of polishing and the polishing body, the polishing torque during polishing rises abruptly immediately after the initiation of polishing, then drops abruptly after a few seconds and reaches a more or less constant value after approximately 10 seconds. Accordingly, if a polishing method has a stage in which a load is gradually applied between the object of polishing and the polishing body, the torque can be prevented from increasing abruptly immediately after the initiation of polishing. As a result, scratching of the object of polishing caused by such an abrupt increase in torque can be prevented. Furthermore, the load on the polishing apparatus is reduced; consequently, not only are the effects of vibration and heat reduced, but a superior effect is obtained which makes it possible to alleviate scratching that tends to occur in cases where a hard polishing pad is used.

A ninth embodiment of the present invention which is used in order to achieve the first aspect is a polishing method in which a polishing head which holds the object of polishing, and a polishing body, are used, and the object of polishing is polished by causing relative motion between the polishing body and the object of polishing in a state in which a polishing agent is interposed between the polishing body and the object of polishing, wherein the method has a stage in which the load between the object of polishing and the polishing body is adjusted so that one of the moving load of the object of polishing and the polishing body is constant.

In this invention as well, an abrupt increase in the torque immediately following the initiation of polishing can be prevented; as a result, scratching of the object of polishing caused by such an abrupt increase in the torque can be prevented. The load on the polishing apparatus is reduced even further; accordingly, not only are the effects of vibration and heat reduced even further, but a superior effect is obtained which makes it possible to achieve a further alleviation of scratching in cases where a hard polishing pad is used.

A tenth embodiment of the present invention which is used in order to achieve the first aspect is a polishing apparatus which is equipped with a polishing head which holds the object of polishing, and a polishing body, and in which the object of polishing is polished by causing relative motion between the polishing body and the object of polishing in a state in which a polishing agent is interposed between the polishing body and the object of polishing; this polishing apparatus being characterized by the fact that one of the polishing bodies of the first embodiment through fifth embodiment is used as the above-mentioned polishing body.

In this invention, one of the polishing bodies of the above-mentioned first embodiment through fifth embodiment is used as the polishing body; accordingly, the effects described for the respective inventions can be exhibited, so that the above-mentioned first aspect can be achieved.

An eleventh embodiment of the present invention which is used in order to achieve the first aspect is a polishing apparatus which is equipped with a polishing head which holds the object of polishing, and a polishing body, and in which the object of polishing is polished by causing relative motion between the polishing body and the object of polishing in a state in which a polishing agent is interposed between the polishing body and the object of polishing; this polishing apparatus being characterized by the fact that the apparatus is equipped with a load-applying mechanism which applies a variable load between the object of polishing and the polishing body, a polishing body moving mechanism which moves the polishing body, an object of polishing moving mechanism which moves the object of polishing, respective load detection mechanisms which are used to detect the load of the movement of the polishing body moving mechanism or the object of polishing moving mechanism, or both, and a feedback mechanism which is used to control the load applied by the load-applying mechanism on the basis of the load value detected by one of the load detection mechanisms.

Accordingly, as was described above, in cases where a fixed load is applied between the object of polishing and the polishing body, the polishing torque during polishing rises abruptly immediately after the initiation of polishing, then drops abruptly after a few seconds and reaches a more or less constant value after approximately 10 seconds. Furthermore, such an abrupt increase in the torque immediately after the initiation of polishing causes scratching of the object of polishing. In this invention, the polishing apparatus is equipped with respective load detection mechanisms which are used to detect the load of the movement of the polishing body moving mechanism or object of polishing moving mechanism, or both, and a feedback mechanism which is used to control the load applied by the load-applying mechanism on the basis of the load values detected by one of the load detection mechanisms. Accordingly, the load (torque) can always be maintained at an appropriate value. Consequently, scratching of the object of polishing caused by the increase in torque can be prevented.

A first embodiment of the present invention which is used in order to achieve the second aspect is a polishing body used in a polishing apparatus in which an object of polishing is polished by causing relative motion between a polishing body and this object of polishing in a state in which a polishing agent is interposed between the polishing body and object of polishing; this polishing body being characterized by the fact that at least the working surface part of the polishing body comprises a non-foam resin, and has a plurality of recessed and projecting parts comprising a groove structure, and this groove structure comprises a combination of one or more types of grooves selected from a set comprising concentric circular, spiral, lattice-form, triangular lattice-form and radial grooves.

As long as at least the working surface part of the polishing body in this embodiment has a groove structure comprising a non-foam resin, this polishing body may be a sheet-form or plate-form polishing body, a polishing body with a multi-layer structure in which different types of materials are laminated, or a plate-form polishing body molded on a rigid flat plate.

Furthermore, the shape of the grooves is important for increasing the polishing rate and eliminating scratches; for this reason, a pattern is selected which is suitable for ensuring the fluidity and retention of the polishing agent, and for effectively discharging polishing debris and aggregated polishing particles. Accordingly, such a pattern is preferably a combination comprising one or more types of grooves selected from a set comprising concentric circular, spiral, lattice-form, triangular lattice-form and radial grooves.

The polishing body of this embodiment is capable of performing polishing with an efficiency comparable to that of conventional foam polishing pads for the amount of polishing agent that is supplied; furthermore, since this polishing body is a hard polishing pad, it is superior in terms of eliminating step differences in patterned wafers.

A second embodiment of the present application which is used in order to achieve the second aspect is the first embodiment, which is further characterized by the fact that the sections of the recessed parts (groove parts) and projecting parts respectively have one or more shapes selected from a set comprising rectangular, trapezoidal and triangular shapes.

In this embodiment, since the sections of the recessed parts (groove parts) and projecting parts respectively have one or more shapes selected from a set comprising rectangular, trapezoidal and triangular shapes, the advantage of easy workability of the grooves to an optimal pitch and width is obtained.

A third embodiment of the present invention which is used in order to achieve the second aspect is the second embodiment which is further characterized by the fact that the rectangular, trapezoidal or triangular shapes satisfy the following conditions:

$$a \geqq b,\ b \geqq 0,\ c \geqq 0$$

wherein, a is the length of the bottom sides of the projecting parts, b is the length of the top sides of the projecting parts, and c is the length of the bottom sides of the recessed parts.

As a result of the use of such a construction, clogging of the grooves during the discharge of polishing debris or aggregated polishing particles is eliminated, so that the discharge of such polishing debris or aggregated polishing particles to the outside of the working surface of the polishing body is smoothly accomplished. Accordingly, the polishing rate can be increased, and scratching of the object of polishing by polishing debris or aggregated polishing particles can be prevented. Furthermore, as a result of the use of such a construction, the merit of simplified working of the grooves is also obtained.

In the polishing body of this embodiment, the fluidity of the polishing agent and the size of the contact area are optimized, so that the polishing rate is rapid; furthermore, since this polishing body is a hard pad, it is superior in terms of elimination of step differences in patterned wafers. Moreover, since the width of the grooves is optimized, the discharge of polishing debris and aggregates of the polishing agent can be smoothly accomplished, and there is no scratching.

A fourth embodiment of the present invention which is used in order to achieve the second aspect is the third embodiment which is further characterized by the fact that the rectangular, trapezoidal or triangular shapes satisfy the following conditions:

$$0.0\ \text{mm} \leqq b \leqq 3.0\ \text{mm},\ 0.1\ \text{mm} \leqq a+c \leqq 5.0\ \text{mm},\ d \geqq 0.1\ \text{mm}$$

wherein, d is the depth of the recessed parts.

The relationship between the amount of polishing of a silicon wafer and the polishing conditions is given by an empirical formula known as the formula of Preston, which is indicated by Equation (1).

$$R = k \times P \times V \tag{1}$$

Here, R is the amount of polishing of the silicon wafer, P is the pressure per unit area with which the silicon wafer is pressed against the polishing body, V is the relative linear velocity caused by the relative motion between the polishing member and the silicon wafer, and k is a proportionality constant.

According to the formula of Preston, the polishing rate is proportional not only to the relative velocity between the polishing body and the object of polishing, but also to the pressure at the contact face between the object of polishing and the polishing body. Since the polishing rate is also proportional to the effective contact area, the polishing rate increases with an increase in the contact area at the same relative velocity and load per unit area. Here, the term "effective" in "effective contact area" refers to the fact that the contact area during polishing adopts an effective value that differs from the value that is simply calculated from the figures, since the state of contact between the polishing body and the object of polishing differs when no pressure is applied and when pressure is applied during polishing, and since the contact between the polishing body and the object of polishing is not perfect in some instances. In the case of a non-foam polishing pad, the polishing rate cannot be increased by means of a simple increase in the contact area, since the polishing agent is not supplied to every part of the above-mentioned contact face, i.e., since the fluidity of the polishing agent is low. The supply of the polishing agent to every part of the above-mentioned contact face can be ensured by increasing the density of the grooves. However, merely increasing the total area of the grooves by simply increasing the groove density is not very effective as a means of increasing the polishing rate. The reason for this is as follows: specifically, since the sum of the total area of the grooves and the contact area is equal to the area of the working surface of the polishing body, an increase in the total area of the grooves causes a decrease in the contact area, and (from the above argument) such a decrease in the contact area lowers the polishing rate. Accordingly, even if the density of the grooves is increased, such an increase in the total area of the grooves cancels the effect of increasing the fluidity of the polishing agent, and therefore cancels the effect that increases the polishing rate. A high groove density is not in itself sufficient to increase the fluidity while avoiding a decrease in the contact area; at the same time, the groove width must be narrowed. The polishing agent can be supplied to all parts of the contact face, and the polishing rate can be increased, by narrowing the groove width and reducing the groove pitch, so that the groove density is increased.

Here, what is important is the role of the grooves. The grooves not only have the function of forming projecting parts on the polishing body, and the function of ensuring the fluidity of the polishing agent by supplying the polishing agent to the projecting parts that constitute the contact face, but also the important function of discharging polishing debris or polishing particles in the polishing agent that have become aggregated (hereafter referred to as "aggregated polishing particles") from the contact face. From this standpoint, it is better if the groove width is not too narrow. The reason for this is as follows: specifically, if the groove width is too narrow, the polishing debris or aggregated polishing particles will clog the grooves while being discharged; as a result, the discharge of the polishing debris or aggregated polishing particles to the outside of the working surface of the polishing body is interrupted, and the contact of such polishing debris or aggregated polishing particles with the object of polishing causes scratching during polishing.

For the above reasons, the groove pitch should be neither too coarse nor too fine, and the groove width should be neither too wide nor too narrow; this pitch and width have respective optimal values.

Here, (a+c) is the groove pitch; the pitch p of the grooves is determined by a trade-off between the mutually conflicting characteristics of favorable polishing agent fluidity and abundant contact area. As a result of experimentation, it has been determined that a value of 0.1 mm to 5.0 mm is desirable. As a result of similar experimentation, it has been determined that a value of 0.0 mm to 3.0 mm is desirable as the length b of the top sides of the projecting parts between the grooves. The lower limit of the depth d of the grooves is determined by the discharge characteristics of the polishing debris or aggregated polishing particles; it has been determined that a value of 0.1 mm or greater is desirable.

A fifth embodiment of the present invention which is used in order to achieve the second aspect is the first embodiment which is further characterized by the fact that the section of the recessed parts (groove parts) of the recessed and projecting parts has a shape that has curved portions.

If the section of the recessed parts (groove parts) of the recessed and projecting parts has a shape that has curved portions, the supply and discharge of the polishing agent are facilitated; furthermore, the size of the angle formed by the grooves and the working surface of the polishing member can be increased, so that the generation of parts with sharp angles in the working surface of the polishing member can be suppressed. As a result, scratching of the object of polishing can be effectively suppressed.

A sixth embodiment of the present invention which is used in order to achieve the second aspect is the fifth embodiment which is further characterized by the fact that the shape that has the curved portions satisfies the following conditions:

$$0.0\ \text{mm} \leqq e \leqq 3.0\text{mm},\ 0.1\ \text{mm} \leqq e+f \leqq 5.0\text{mm},\ g \geqq 0.1\ \text{mm}$$

wherein, e is the length of the top side of the projecting parts, f is the length of the top side of the recessed parts, and g is the depth of the recessed parts.

The reasons for limiting the respective numerical values in this manner are the same as the reasons for limiting the numerical values in the fourth embodiment.

A seventh embodiment of the present invention which is used in order to achieve the second aspect is any of the first through sixth embodiments which is further characterized by the fact that the recessed and projecting parts have a periodic structure of recesses and projections.

In the present invention, since the recessed and projecting parts have a periodic structure, working is simplified, and this working can be accomplished using automated working machinery.

An eighth embodiment of the present invention which is used in order to achieve the second aspect is any of the first through seventh embodiments which is further characterized by the fact that the non-foam resin has a Vickers hardness of 1.5 kgf/mm$^2$ or greater, or a compressive Young's modulus of 25 kgf/mm$^2$ or greater.

One major special feature of hard non-foam polishing members is smoothness, i.e., efficient elimination of pattern step differences. When the hardness of a polishing member drops, the step difference elimination characteristics of this polishing member deteriorate. As a result, it has been found that residual step differences can be suppressed to a degree that there are no problems, and that both a high polishing rate and a good smoothness can be obtained, in cases where the Vickers hardness of the material of the polishing member is 1.5 kgf/mm$^2$ (approximately $1.5\times10^7$ Pa) or greater, or in cases where the compressive Young's modulus of this material is 25 kgf/mm$^2$ (approximately $2.5\times10^8$ Pa) or greater.

A ninth embodiment of the present invention which is used in order to achieve the second aspect is a polishing apparatus in which an object of polishing is polished by causing relative motion between a polishing body and this object of polishing in a state in which a polishing agent is interposed between the polishing body and object of polishing; this polishing apparatus being characterized by the fact that the apparatus uses the polishing body of one of the first through eighth embodiments as a polishing body.

Since this polishing apparatus uses the polishing body of one of the first through eighth embodiments, the respective effects of the first through eighth embodiments can be obtained, so that the above-mentioned second aspect can be achieved.

A tenth embodiment of the present invention which is used in order to achieve the above-mentioned second aspect is a method in which an object of polishing is polished by causing relative motion between a polishing body and this object of polishing in a state in which a polishing agent is interposed between the polishing body and object of polishing; this polishing method being characterized by the fact that the method uses the polishing body of the eighth embodiment as a polishing body, and the fact that the method includes a stage in which the temperature of the polishing body is controlled.

The polishing rate is proportional to the contact area. However, contact between solids is generally a point contact. Since the non-foam polishing member of the present invention uses a hard material, the effective contact area is lower than a value that is simply calculated from the figures; accordingly, the polishing rate may also be lower than the expected value. Consequently, the temperature dependence of the hardness of the resin of the polishing pad material is utilized in order to adapt the projecting parts as a whole to the object of polishing. The hardness of the resin drops with a rise in temperature. The fit of the hardness of the polishing pad with respect to the object of polishing is improved by elevating the temperature or controlling the temperature. The polishing rate depends on the temperature, and increases with an increase in the temperature. Causes of this increase in the polishing rate include an increase in the reactivity of the slurry in addition to an increase in the effective contact area. Accordingly, the polishing rate can be increased, or a specified polishing rate can be maintained, by controlling the temperature of the polishing body.

A first embodiment of the present invention which is used in order to achieve the third aspect is a polishing body used in a polishing apparatus in which an object of polishing is polished by causing relative motion between a polishing body and this object of polishing in a state in which a polishing agent is interposed between the polishing body and object of polishing; this polishing body being characterized by the fact that the polishing body has grooves formed in its surface, the width W of the above-mentioned grooves at the surface is such that 0.1 mm≦W≦2.0 mm, the ratio VL of the volume of the region in which the grooves are formed to the volume of the polishing body including the region in which the grooves are formed is such that 0.1%≦VL≦30%, and the polishing body is formed from a material in which the void region caused by foaming is 20% or less relative to the volume of the polishing body not including the region in which the grooves are formed.

In the polishing body, the material of the polishing body is a non-foam type or low-foam type material; accordingly, the polishing body shows extremely little wear due to use. Furthermore, dressing is either unnecessary or else is accomplished in a short time, so that there is no change in the groove structure due to wear; accordingly, extremely stable polishing characteristics can be obtained. As a result of these features, the frequency of polishing body replacement is reduced, so that the cost of polishing can be reduced. Furthermore, among the polishing characteristics, uniformity, smoothness and the polishing rate can be controlled according to the groove structure (groove width W, volume ratio VL) formed in the surface of the polishing body. Thus, the groove structure can be selected so that ideal polishing characteristics are obtained. As a result, the polishing yield can be improved, and the time required for polishing can be shortened, so that the cost of polishing can be reduced.

A second embodiment of the present invention which is used in order to achieve the third aspect is the first embodiment which is further characterized by the fact that the thickness D is such that 0.5 mm≦D≦5.0 mm.

As a result, among the polishing characteristics, uniformity, smoothness and the polishing rate can be controlled according to the thickness D of the polishing body; accordingly, the thickness can be selected so that ideal polishing characteristics are obtained. Consequently, the polishing yield can be improved, and the time required for polishing can be shortened, so that the cost of polishing can be reduced.

A third embodiment of the present invention which is used in order to achieve the third aspect is the first embodiment or second embodiment which is further characterized by the fact that the depth of the above-mentioned grooves is no more than three times the width W of the grooves.

As a result, there is no scratching of the polished surface of the object of polishing. Accordingly, the polishing yield can be improved, and the cost of polishing can be reduced.

A fourth embodiment of the present invention which is used in order to achieve the third aspect is any of the first through third embodiments which is further characterized by the fact that the shape of the grooves with respect to the surface is a spiral shape, concentric circular shape, lattice shape, triangular lattice shape, "knitted" shape, random shape or shape which includes two or more of the preceding shapes.

As a result, the polishing agent retention capacity at the surface of the polishing body is high, so that the polishing rate is increased, and the uniformity is also increased. Accordingly, the polishing yield is improved, and the time required for polishing is shortened, so that the cost of polishing can be reduced.

A fifth embodiment of the present invention which is used in order to achieve the third aspect is any of the first through fourth embodiments which is further characterized by the fact that the sectional shape of the grooves is a shape that has a curvature, a rectangular shape, a V shape or a polygonal shape.

As a result, scratching of the polished surface of the object of polishing is eliminated. Accordingly, the polishing yield is improved, and the cost of polishing can be reduced.

A sixth embodiment of the present invention which is used in order to achieve the third aspect is any of the first through fifth embodiments which is further characterized by the fact that the compressive elastic modulus K of the material is such that 0.1 GPa≦K≦2.0 GPa.

In the present means, since the material is not too soft, the amount of wear during polishing is small, so that the polishing body has a long useful life; furthermore, there is no deterioration in smoothness. Moreover, since the material is not too hard, there is no scratching of the object of polishing, and there is also no deterioration in uniformity.

As a result, the polishing yield can be increased in the case of a polishing body formed from a material whose compressive elastic modulus K is such that 0.1 GPa≦K≦2.0 GPa, so that the cost of polishing can be reduced.

A seventh embodiment of the present invention which is used in order to achieve the third aspect is any of the first through sixth embodiments which is further characterized by the fact that the chief component of the material comprises one or more resins selected from a set comprising epoxy resins, acrylic resins, polyester resins, vinyl chloride resins, polycarbonate resins and non-foam urethane resins.

As a result, there is little wear of the polishing body caused by polishing, so that the useful life of the polishing body is increased. Accordingly, the frequency with which the polishing body is replaced is reduced, so that the cost of polishing can be reduced.

An eighth embodiment of the present invention which is used in order to achieve the third aspect is any of the first through seventh embodiments which is further characterized by the fact that a first plurality of grooves that supply and discharge the polishing agent are further formed in the surface, and the grooves that supply and discharge the polishing agent form parts of the previously mentioned grooves, or are formed separately from the grooves.

As a result, since the polishing agent is uniformly supplied to the entire polished surface of the object of polishing, there is no deterioration in uniformity, and no deterioration in the polishing characteristics due to an increase in wear. Accordingly, the polishing yield can be increased, and the cost of polishing can be reduced.

A ninth embodiment of the present invention which is used in order to achieve the third aspect is any of the first through eighth embodiments which is further characterized by the fact that there is a transparent region in at least one portion of the polishing body.

As a result, the polished state of the polished surface of the object of polishing can be detected in situ during the polishing process by means of a device that observes the polished state via the opening part formed in the polishing platen and the transparent region of the polishing body. Accordingly, since the endpoint of polishing can be detected during the polishing process, the polishing yield can be increased, and the cost of polishing can be reduced. For example, vinyl chloride, etc., can be used as the material that constitutes the transparent region.

A tenth embodiment of the present invention which is used in order to achieve the third aspect is a polishing apparatus in which an object of polishing is polished by causing relative motion between a polishing body and this object of polishing in a state in which a polishing agent is interposed between the polishing body and object of polishing; this polishing apparatus being characterized by the fact that any of the first through ninth embodiments is used as the polishing body.

In this invention, since one of the above-mentioned first through ninth embodiments is used as the polishing body, the advantages of the respective corresponding polishing bodies can be obtained, so that the above-mentioned third aspect can be achieved.

A first embodiment of the present invention which is used in order to achieve the fourth aspect is a polishing body used in a polishing apparatus in which an object of polishing is polished by causing relative motion between a polishing body and this object of polishing in a state in which a polishing agent is interposed between the polishing body and object of polishing; this polishing body being characterized by the fact that recessed and projecting structures of two or more different types are formed periodically or aperiodically in the surface of the polishing body.

In the above-mentioned polishing body, two or more types of recessed and projecting structures are formed; accordingly, in regard to the polishing characteristics, areas in which the uniformity is good and areas in which the smoothness is good coexist in accordance with the recessed and projecting structures. As a result, both the uniformity and the smoothness are improved.

Specifically, a hard polishing body and a soft polishing body can be caused to coexist in apparent terms in the same polishing body by forming two or more types of recessed and projecting structures on the surface of the polishing body without modifying the laminated structure of the polishing body or the polishing head. Accordingly, a polishing body and a polishing method using this polishing body can be provided which make it possible to improve the polishing characteristics of uniformity and smoothness, which are generally said to be in a trade-off, even if a conventional polishing apparatus is used. This also offers the advantage of making it possible to increase the yield of the semiconductor manufacturing process without incurring any expense in the polishing process.

A second embodiment of the present invention which is used in order to achieve the fourth aspect is the first embodiment which is further characterized by the fact that two or more recessed parts of the recessed and projecting structures and two or more projecting parts of the recessed and projecting structures are formed within the regions in which recessed and projecting structures of the same type are formed.

As a result, the uniformity and smoothness are improved even further.

A third embodiment of the present invention which is used in order to achieve the fourth aspect is the second embodiment which is further characterized by the fact that the recessed and projecting structures comprise two types of recessed and projecting structures, i.e., a first recessed and projecting structure and a second recessed and projecting structure, the recessed parts of the first recessed and projecting structure and the recessed parts of the second recessed and projecting structure are grooves, and the width of the projecting parts of the first recessed and projecting structure is two or more times the width of the projecting parts of the second recessed and projecting structure.

As a result, the regions of the polishing body in which the first recessed and projecting structure with wide projecting parts is formed function in a manner comparable to that of a hard polishing body, and selectively polish the projecting parts of the recessed and projecting pattern during the polishing of an object of polishing that has such a recessed and projecting pattern, so that the smoothness is improved. Meanwhile, the regions of the polishing body in which the second recessed and projecting structure with narrow projecting parts is formed function in a manner comparable to that of a soft polishing body, so that the polishing body performs polishing while conforming to any warping of the object of polishing or irregularity in the film thickness generated during the formation of any film on the surface of the object of polishing. As a result, the uniformity is improved.

A fourth embodiment of the present invention which is used in order to achieve the fourth aspect is any of the first through third embodiments which is further characterized by the fact that the plan shape of the polishing body is circular, and the regions in which the recessed and projecting structures of the same type are formed are disposed in the form of concentric circles.

As a result, the uniformity and smoothness are further improved.

A fifth embodiment of the present invention which is used in order to achieve the fourth aspect is any of the first through third embodiments which is further characterized by the fact that the regions in which the above-mentioned recessed and projecting structures of the same type are formed are disposed in a lattice-form configuration.

As a result, the uniformity and smoothness are further improved.

A sixth embodiment of the present invention which is used in order to achieve the fourth aspect is any of the first through fifth embodiments which is further characterized by the fact that grooves that supply and discharge the polishing agent are further formed in the surface of the polishing body.

As a result, since the polishing agent is uniformly supplied to the entire surface of the object of polishing, there is no deterioration in the uniformity, or deterioration in the characteristics of the polishing apparatus as a result of increased wear.

A seventh embodiment of the present invention which is used in order to achieve the fourth aspect is any of the first through sixth embodiments which is further characterized by the fact that the Vickers hardness k of the polishing body is such that $2.5\ (kgf/mm^2)<k<30\ (kgf/mm^2)$.

As a result, the uniformity and smoothness are further improved.

An eighth embodiment of the present invention which is used in order to achieve the fourth aspect is any of the first through seventh embodiments which is further characterized by the fact that the polishing body is constructed from a first layer in the surface of which the recessed and projecting structures are formed, and a second layer which is disposed beneath the first layer and to which the first layer is laminated, and the elastic modulus of the second layer is greater than the elastic modulus of the first layer.

As a result, the uniformity and smoothness can be improved in a polishing body with a laminated structure as well.

A ninth embodiment of the present invention which is used in order to achieve the fourth aspect is a polishing apparatus in which an object of polishing is polished by causing relative motion between a polishing body and this object of polishing in a state in which a polishing agent is interposed between the polishing body and object of polishing; this polishing apparatus being characterized by the fact that any of the first through eighth embodiments is used as the polishing body.

In this invention, since the polishing body of one of the first through eighth embodiments is used, the respective effects described for these inventions can be exhibited, so that the above-mentioned fourth aspect can be achieved.

An invention of the present invention which is used in order to achieve each of the first through fourth aspects is a semiconductor device manufacturing method which is characterized by the fact that this method includes a process in which a wafer is polished using at least one method or apparatus among the polishing methods of the sixth through ninth embodiments to achieve the first aspect, and the polishing apparatuses of the tenth and eleventh embodiments to achieve the first aspect, the ninth and tenth embodiments to achieve the second aspect, the tenth embodiment to achieve the third aspect and the ninth embodiment to achieve the fourth aspect.

In this invention, since polishing methods or apparatuses with respective advantages are utilized, wafers can be polished in accordance with the above-mentioned first through fourth objects. Accordingly, semiconductor devices can be manufactured with a good precision, yield and throughput.

BRIEF DESCRIPTION OF THE DRAWINGS

FIG. 1A shows the state before planarization and FIG. 1B shows the state following planarization.

FIGS. 21A and 21B are diagrams which illustrates a polishing body constituting an example of the present invention.

FIGS. 22A and 22B are diagrams which illustrates a polishing body constituting an example of the present invention.

DETAILED DESCRIPTION OF THE PREFERRED EMBODIMENTS

Below, examples will be described with reference to the attached figures in order to describe the present invention in greater detail. However, the present invention is described here in terms of examples and embodiments, and this description should not be interpreted as limiting the content of the invention.

First, examples and embodiments of the invention for the purpose of achieving the first aspect of the present invention will be described.

EXAMPLE 1-1

In the polishing pad (polishing body) of the present example, there is no flash in the groove structure formed in the surface of the polishing pad. Accordingly, it is important first of all to adopt a groove structure forming method that does not generate any flash, and for this purpose, it is also important to perform a treatment that conditions the surface of the polishing pad following groove formation. In the present invention, attention was focused on eliminating flash that might be stripped away from the polishing pad during polishing.

Figure 3A:
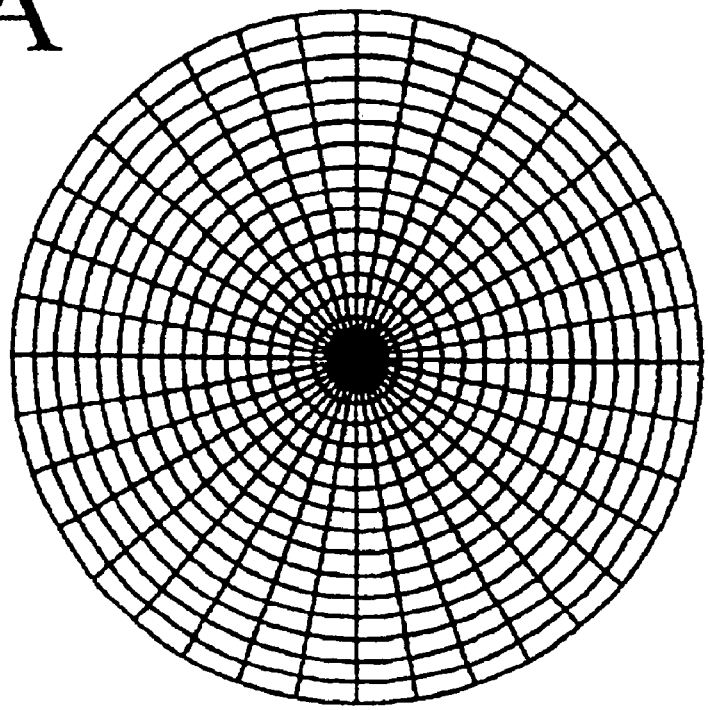
FIGS. 3A and 3B illustrate an example of the polishing pad of the CMP polishing apparatus used in the present invention.
Figure 3B:
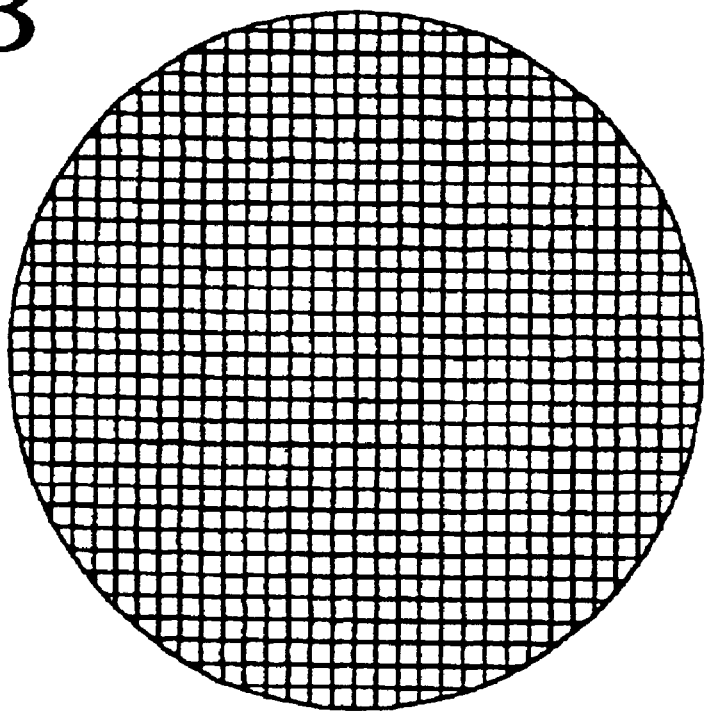

In the groove structure of the polishing pad of the present example, the angles of intersection at the points of intersection where the plurality of grooves that constitute the groove structure intersect does not include any sharp angles of 2 degrees or less. As a result, flash that might be stripped away during polishing can be greatly reduced. For this purpose, a combination of concentric circular and radial grooves (FIG. 3A), a combination of spiral and radial grooves, or a structure comprising exclusively of lattice-form grooves (FIG. 3B), is most effective. In the case of these groove structures, the angle of intersection of the grooves is 90 degrees. In the case of radial grooves, the groove structure is arranged so that the angles of intersection at the point of intersection (ordinarily in the central portion of the polishing pad) where the plurality of grooves that constitute the radial grooves intersect are 2 degrees or greater. For this purpose, in a case where the plurality of grooves that constitute the radial grooves are disposed at equal angular intervals, it is desirable that the number of grooves not exceed 180 grooves. Furthermore, it is desirable that the lengths of the plurality of grooves that constitute the radial grooves be mixed as alternating long and short lengths, and that the terminal ends of the plurality of shorter radial grooves on the center side of the polishing pad be disposed in the form of a concentric circle in the vicinity of the center of the polishing pad. Thus, it is desirable that there be no sharp edge parts on the working surface of the polishing pad; in concrete terms, it is desirable that there be no edge surfaces with a curvature radius of less than 50 $\mu$m on the working surface of the polishing pad.

EXAMPLE 1-2

The present example is a slurry that is used in combination with Example 1-1.

This slurry tends not to undergo aggregation.

A slurry that contains cerium oxide is desirable for use as a slurry that tends not to aggregate. Generally, slurries that contain silicon dioxide ($SiO_2$) are widely used for the polishing of dielectric materials by CMP. Such slurries are superior in terms of stability, but tend to aggregate and form a glass. Such aggregates form on the surface of the polishing pad. In cases where the location at which the aggregate forms is inside a groove, the aggregate does not cause scratching; however, in cases where this aggregate forms outside a groove, i.e., on one of the projecting parts, the aggregate tends to cause scratching. Slurries that contain cerium oxide are easily disperses in water; furthermore, such slurries are easily washed away by water, and tend not to form aggregates. Accordingly, such slurries are suitable for use with hard polishing pads comprising non-foam resins (hereafter referred to as "non-foam polishing pads"). In cases where slurries of cerium oxide are used with foam polishing pad, the retention force of the slurry in the foam of the working surface of the polishing pad is high; as a result, the cerium oxide abrasive particles remain in an excessive amount, and affect the stability of polishing. Specifically, the polishing rate changes as time passes, and the response to the control operation of the slurry supply is slow. In the case of non-foam polishing pads, on the other hand, the retention force is low, so that the effects of previous states are not dragged out; as a result, the control of the slurry concentration is immediately reflected in the polishing characteristics, and especially in the polishing rate, so that stable polishing characteristics can be maintained. Furthermore, in cases where a non-foam polishing pad is combined with a silicon oxide slurry, it is difficult to increase the polishing rate; however, a high polishing rate can be obtained by combining such a polishing pad with a cerium oxide slurry.

EXAMPLE 1-3

Figure 4:
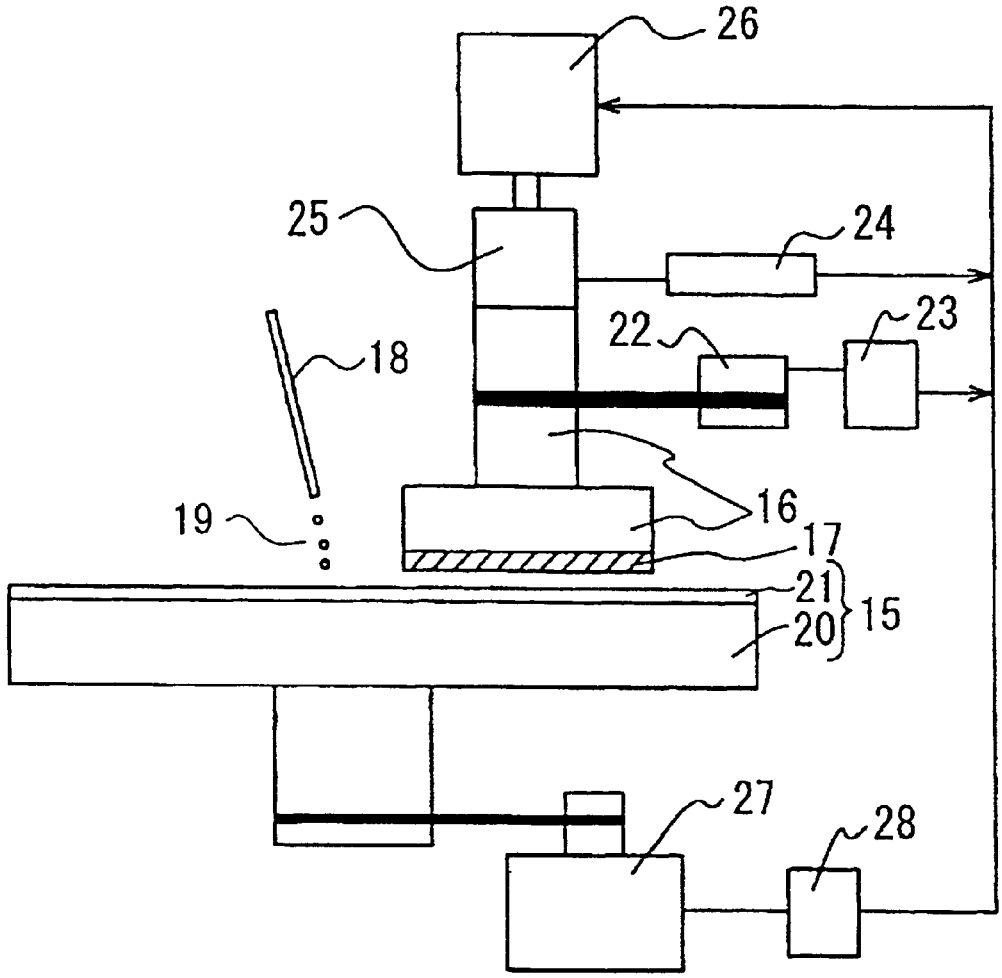
FIG. 4 illustrates an example of a polishing apparatus that has the torque detection mechanism of the present invention.

The present example is a polishing apparatus which is shown in FIG. 4, and which reduces scratching. Furthermore, in the following figures, elements which are the same as in previous figures are labeled with the same symbols, and a description of these elements is omitted.

In FIG. 4, 22 indicates a rotating motor which rotates a polishing head 16, 23 indicates a rotational torque detection mechanism which detects the rotational torque of the rotating motor 22, 24 indicates an oscillating motion load detection mechanism (which detects rectilinear oscillating motion parallel to the working surface of the polishing pad), 25 indicates an oscillating mechanism which imparts an oscillation motion to the polishing head 16, and 26 indicates a load-applying mechanism which applies a load to the surface that is being polished on a silicon wafer 17. This load-applying mechanism is equipped with a load adjustment mechanism that can adjust the load in accordance with a load or rotational torque signal received from the outside. 27 indicates a platen-rotating motor, and 28 indicates a rotational torque detection mechanism which detects the rotational torque of the platen rotation. The polishing head 16 holds the silicon wafer 17, and rotates the silicon wafer 17. The polishing member 15 is constructed by pasting a polishing pad (polishing body) 21 to the surface of a polishing platen 20.

A polishing pad comprising a non-foam resin which has a groove structure formed in its surface is used as the polishing pad 21. The polishing head 16 is caused to perform a rotational motion by the rotating motor 22, and the polishing member 15 is caused to perform a rotational motion by the platen-rotating motor 27. In this process, the surface that is being polished on the silicon wafer 17 is polished by the action of the polishing agent 19 and polishing pad 21.

This polishing apparatus operates as follows: during polishing, the platen torque detection mechanism 28 detects the rotational torque of the platen-rotating motor 27, the polishing head torque detection mechanism 23 detects the rotational torque of the polishing head rotating motor 22, and the oscillating load detection mechanism 24 detects the oscillating load from the oscillating mechanism 25. A torque or load signal from the platen torque detection mechanism 28, polishing head torque detection mechanism 23 or oscillating load detection mechanism 24 is fed back to the load-applying mechanism 26; then, the load-applying mechanism 26 compares this torque or load signal with a preset reference signal, and increases or decreases the load in accordance with the difference between these two signals. In concrete terms, the load-applying mechanism 26 decreases the load when the torque or load is greater than the reference value, and conversely increases the load when the torque or load is smaller than the reference value. In this way, the rotational torque or oscillating load caused by the load on the surface that is being polished, which is generated as a result of the load applied by the load-applying mechanism 26, is always maintained at a constant value.

The object of this torque or load control is preferably the polishing head rotating motor 22.

In the above example, the torque or load was continuously controlled during polishing; however, in a simpler arrangement, it would also be possible merely to apply the load in stages to the polishing head as shown in FIG. 4, without performing feedback control of the torque or load. In such a case, there is no need for functions such as a load adjustment mechanism that adjusts the load in accordance with the external signal that is required for feedback control.

Figure 5A:
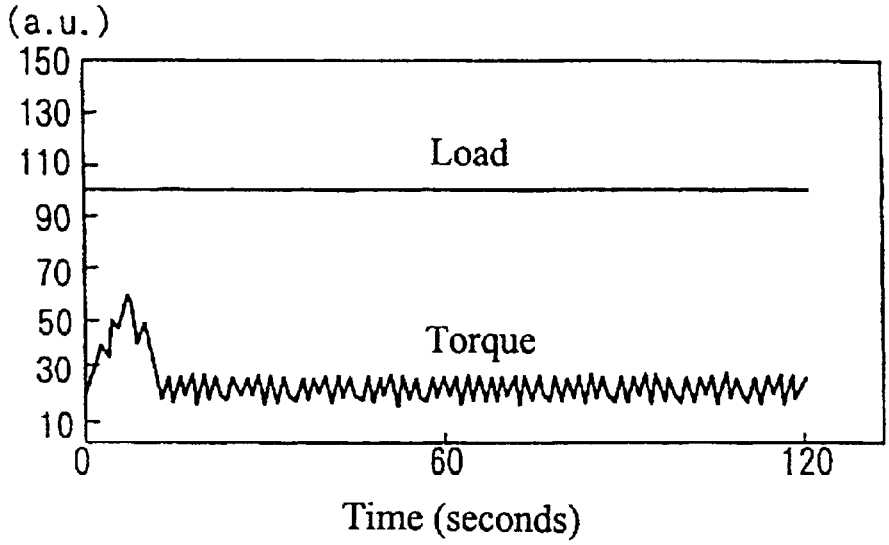
FIGS. 5A and 5B show graphs which illustrate the trends of the load and torque over time in the CMP apparatus.
Figure 5B:
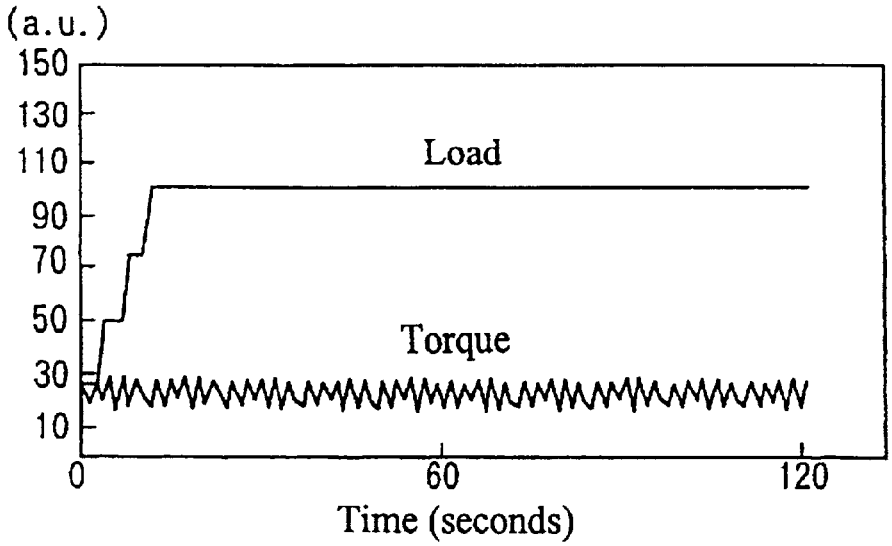

FIG. 5 shows the variation over time of the load applied to the polishing head and the rotational torque of the polishing head rotating motor in a case where the polishing member and polishing head are both rotating at a constant speed. FIG. 5A shows a case in which a fixed load is applied simultaneously with the initiation of polishing, while FIG. 5B shows a case in which the load is gradually increased to a fixed value in stages from the initiation of polishing. FIG. 5A indicates that the torque rises abruptly immediately following the initiation of polishing, then drops abruptly after a few seconds, and finally settles at a fixed value after approximately 10 seconds. This indicates a transition from static friction to dynamic friction. In FIG. 5B, on the other hand, the torque stabilizes at a more or less fixed value immediately after the initiation of polishing.

The present invention was devised on the basis of an inference that it should be possible to prevent scratching if the torque is controlled to as constant a value as possible, this inference being based on a consideration of the effects of such an abrupt increase in the torque immediately following the initiation of polishing on the polishing member and object of polishing, e.g., on experimental results indicating that scratching of the surface of the object of polishing tends to occur in the case of such an abrupt change, etc. As a result, it has become possible not only to reduce scratching, but also to suppress the generation of excessive vibration and heat, so that stable polishing results can be obtained.

The above description has concerned examples in which both the polishing head and platen were rotated for purposes of movement. However, it goes without saying that the present invention is also effective in cases where one of these parts performs a rectilinear motion, i.e., in cases where a so-called relative motion is performed. Furthermore, in FIG. 4, the oscillating mechanism is installed on the side of the polishing head; however, it goes without saying that it would also be possible to install this mechanism on the side of the polishing body.

Embodiment 1-1

The following embodiment corresponds to Example 1-1.

Figure 6:
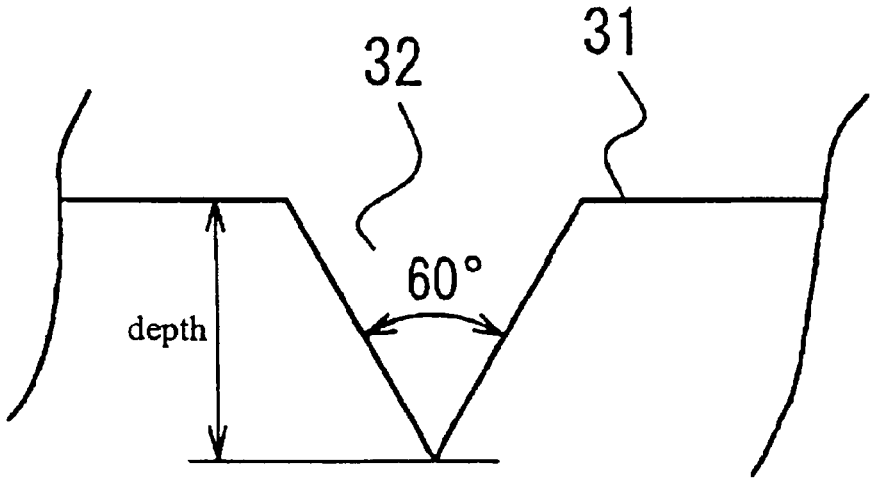
FIG. 6 is a diagram which shows an example of the sectional shape of the grooves in the polishing pad of the present invention.

First, a hard polishing pad was manufactured as follows:

In regard to the materials used, epoxy principal agents Epicote 828 and Epicote 871 (both manufactured by Yuka Shell Epoxy K.K.) and a diaminodiphenylmethane curing agent were mixed and agitated at a weight ratio of 2.6:3.9:1, and this mixture was caused to flow into a mold with a size of ϕ 800 mm. The mixture was then cured by being heated for 8 hours at 150° C. Next, a spiral-form V groove (angle of V 60°) with a pitch of 0.5 mm and a depth of 0.3 mm, and radial grooves with a width of 2 mm, a depth of 0.5 mm and a spacing of 5 degrees, were formed in the surface of the above-mentioned epoxy resin by cutting, thus forming a polishing pad. FIG. 6 shows an enlarged view of the sectional shape of these grooves. In FIG. 6, 31 indicates the surface of the polishing pad, and 32 indicates the grooves in the polishing pad.

This polishing pad was bonded to the platen by means of a two-sided tape, thus forming a polishing body. A 6-inch silicon wafer on which a thermal oxidation film was formed to a thickness of 1 μm was fastened to the elastic film (backing film) of the polishing head by surface tension as an object of polishing, and polishing was performed under the polishing conditions shown below:

Polishing Conditions

Polishing pad rpm: 50 rpm

Polishing head rpm: 50 rpm

Oscillation distance: 30 mm

Oscillation frequency: 15 reciprocating strokes per minute

Polishing agent: SEMI Supers 25 manufactured by Cabot Co., diluted 2X (silicon oxide slurry)

Polishing agent flow rate: 200 ml/min

Load on wafer: 460 gf/cm$^2$

When the polishing rate of the wafer thus polished was measured, a value of 200 nm/min was obtained. When the polished surface was inspected by means of a scratch inspector, no scratches were discovered.

COMPARATIVE EXAMPLE 1-1

Figure 7:
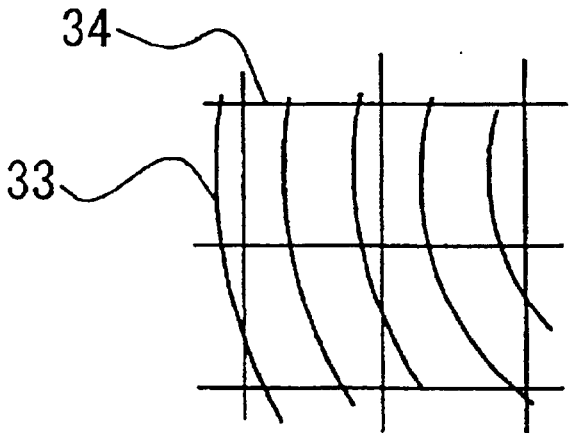
FIG. 7 is partial enlarged plan view of a groove structure combining a spiral groove and lattice-form grooves in a conventional polishing pad.

A polishing pad was manufactured under the same conditions as in Embodiment 1-1, except for the groove structure. The groove structure was formed by a combination of spiral and lattice-form grooves as shown in the enlarged plan view of a polishing pad shown in FIG. 7. In FIG. 7, 33 indicates a spiral groove, and 34 indicates lattice-form grooves.

The same silicon wafer used in Embodiment 1-1 was polished under exactly the same conditions as in Embodiment 1-1 using this polishing pad. When the wafer thus polished was inspected by means of a scratch inspector, occasional scratches were seen in the polished surface. The reason for this is that the polishing pad included portions in which the angles of intersection of the grooves were sharp angles of less than 2 degrees.

Embodiment 1-2

Using a polishing pad that was manufactured under the same conditions as in Embodiment 1-1, the same wafer as that used in Embodiment 1-1 was polished under the same conditions as in Embodiment 1-1, except that a slurry containing 5 wt % cerium oxide particles was used as the polishing agent. As a result, a polishing rate of 420 nm/min was obtained. When the polished surface was inspected by means of a scratch inspector, no scratches were discovered.

Embodiment 1-3

Polishing was performed using the same polishing pad, the same wafer and the same polishing conditions as in Comparative Example 1-1, except that the load on the wafer was increased in stages from 0 to 400 gf/cm$^2$ over a period of approximately 10 seconds as shown in FIG. 5(*b*) by applying a load to the polishing head in stages using the load-applying mechanism 26 shown in FIG. 4.

When the wafer thus polished was inspected by means of a scratch inspector, no scratches were discovered.

Furthermore, polishing was performed using the same polishing pad on the same wafer under the same polishing conditions as in Embodiment 1-1, except that the load on the wafer was increased in stages from 0 to 400 gf/cm$^2$ over a period of approximately 10 seconds.

When the wafer thus polished was inspected by means of a scratch inspector, no scratches were discovered.

Thus, as a result of the load being increased in stages, an abrupt increase in the rotational load (torque) of the platen and polishing head was prevented, so that the torque was more or less constant from the initial stage of polishing.

In the description of the above-mentioned examples and embodiments, polishing was performed with the load applied to the polishing head controlled or varied in stages. However, since the pressure involved is relative pressure, it goes without saying that the effect of the present invention is unchanged even if the load involved is the load on the polishing body.

Below, examples and embodiments of the invention for the purpose of achieving the second aspect of the present invention will be described.

EXAMPLE 2-1

Figure 8:
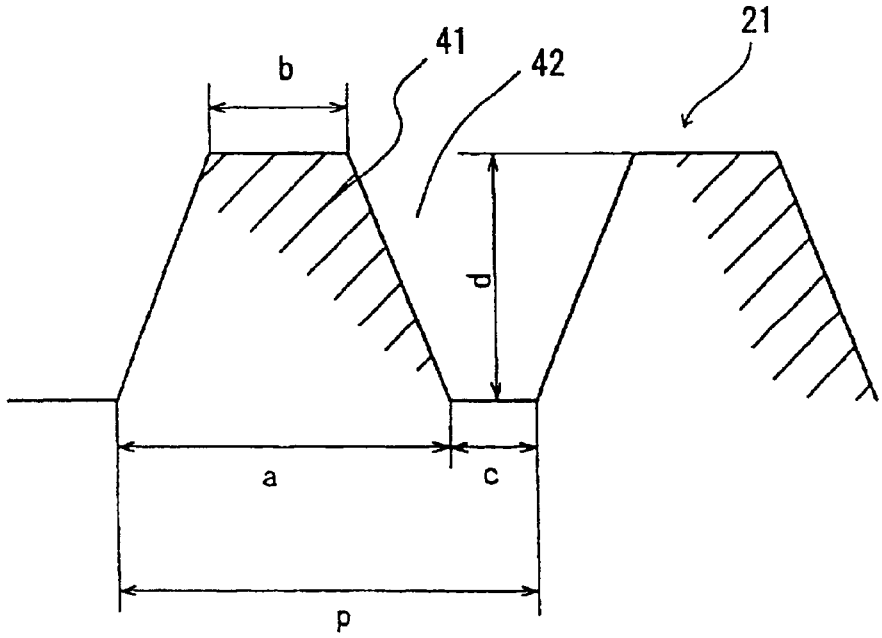
FIG. 8 illustrates an example of the sectional structure of the groove structure in a working configuration of the present invention.

FIG. 8 is a diagram which shows an enlarged section of the recessed and projecting parts comprising a groove structure in the working surface part of a polishing body 21 constructed according to Example 2-1 of the present invention. 41 indicates the projecting parts, and 42 indicates the recessed parts (groove parts). a is the length of the bottom sides of the projecting parts 41, b is the length of the top sides of the projecting parts 41, c is the length of the bottom sides of the recessed parts (groove parts) 42, and d is the depth of the recessed parts (groove parts) 42. Here, it is desirable that the recessed and projecting parts have a periodic structure. In this case, p in FIG. 8 is the pitch of the periodic structure of the recesses and projections of the recessed and projecting parts (hereafter referred to as the "pitch of the grooves"), and p−b is the width of the grooves 42 (i.e., of the top parts of the recessed parts). Only the working surface part of the polishing body is shown in FIG. 8; however, the polishing body of the present invention may be a sheet-form body or plate-form body, and may have a multi-layer structure in which materials of different types are laminated, or a plate-form structure molded on top of a flat plate that possesses rigidity, as long as at least the working surface part of the polishing body has a groove structure comprising a non-foam resin.

Here, according to the above-mentioned formula of Preston, the polishing rate is proportional not only to the relative velocity between the polishing body and object of polishing, but also to the pressure at the contact face between the object of polishing and the polishing body. Since the polishing rate is also proportional to the effective contact area, the polishing rate increases with an increase in the contact area in a case where the load per unit area and relative velocity are the same. Here, the term "effective" in "effective contact area" refers to the fact that the contact area during polishing adopts an effective value that differs from the value that is simply calculated from the figures, since the state of contact between the polishing body and the object of polishing differs when no pressure is applied and when pressure is applied during polishing, and since the contact between the polishing body and the object of polishing is not perfect in some instances. In the case of a non-foam polishing pad, the polishing rate cannot be increased by means of a simple increase in the contact area, since the polishing agent is not supplied to every part of the above-mentioned contact face, i.e., since the fluidity of the polishing agent is low. The supply of the polishing agent to every part of the above-mentioned contact face can be ensured by increasing the density of the grooves. However, merely increasing the total area of the grooves by simply increasing the groove density is not very effective as a means of increasing the polishing rate. The reason for this is as follows: specifically, since the sum of the total area of the grooves and the contact area is equal to the area of the working surface of the polishing body, an increase in the total area of the grooves causes a decrease in the contact area, and (from the above argument) such a decrease in the contact area lowers the polishing rate. Accordingly, even if the density of the grooves is increased, such an increase in the total area of the grooves cancels the effect of increasing the fluidity of the polishing agent, and therefore cancels the effect that increases the polishing rate. A high groove density is not in itself sufficient to increase the fluidity while avoiding a decrease in the contact area; at the same time, the groove width must be narrowed. The polishing agent can be supplied to all parts of the contact face, and the polishing rate can be increased, by narrowing the groove width and reducing the groove pitch, so that the groove density is increased.

Here, what is important is the role of the grooves. The grooves not only have the function of forming projecting parts on the polishing body, and the function of ensuring the fluidity of the polishing agent by supplying the polishing agent to the projecting parts that constitute the contact face, but also the important function of discharging polishing debris or polishing particles in the polishing agent that have become aggregated (hereafter referred to as "aggregated polishing particles") from the contact face. From this standpoint, it is better if the groove width is not too narrow. The reason for this is as follows: specifically, if the groove width is too narrow, the polishing debris or aggregated polishing particles will clog the grooves while being discharged; as a result, the discharge of the polishing debris or aggregated polishing particles to the outside of the working surface of the polishing body is interrupted, and the contact of such polishing debris or aggregated polishing particles with the object of polishing causes scratching during polishing.

For the above reasons, the groove pitch should be neither too coarse nor too fine, and the groove width should be neither too wide nor too narrow; this pitch and width have respective optimal values.

In FIG. 8, the desirable range of the width (p−b) of the grooves depends on the dimensions of the polishing debris or aggregated polishing particles that are discharged from the grooves; in the case of a silicon oxide type slurry, a range of 0.05 mm to 4.5 mm is desirable.

With the groove width, which is limited as described above, thus being restricted, the pitch p of the grooves is determined by a tradeoff between the mutually conflicting characteristics of favorable fluidity of the polishing agent and size of the contact area. As a result of experiments, it was found that a value of 0.1 mm to 5.0 mm is desirable. Furthermore, it was also found that a range of 0.0 mm to 3.0 mm is desirable for the length b of the top sides of the projecting parts of the grooves.

Furthermore, in regard to the relationship of the length a of the bottom side and the length b of the top side of each projecting part, it is desirable that a be equal to or greater than b, and that the length b of the top side be equal to or greater than zero. Furthermore, it is desirable that the length c of the bottom side of each recessed part be equal to or greater than zero. As a result of these values being set so that $a \geqq b$, not only is manufacture facilitated, but a structure that is strong with respect to forces in the shear direction can be obtained. Furthermore, in cases where b=0, the top sides of the projecting parts have the form of an edge. However, under polishing conditions in which these edge-form projecting parts are pressed against the object of polishing, the edge portions are compressed, so that they contact the object of polishing with a finite area. Accordingly, even in cases where b=0, the effective contact area is not zero. The lower limit of the depth d of the grooves is determined by the discharge characteristics of polishing debris or aggregated polishing particles, and is preferably 0.1 mm or greater. Furthermore, a periodic structure in the recessed and projecting parts facilitates manufacture, and is therefore desirable.

EXAMPLE 2-2

Figure 9:
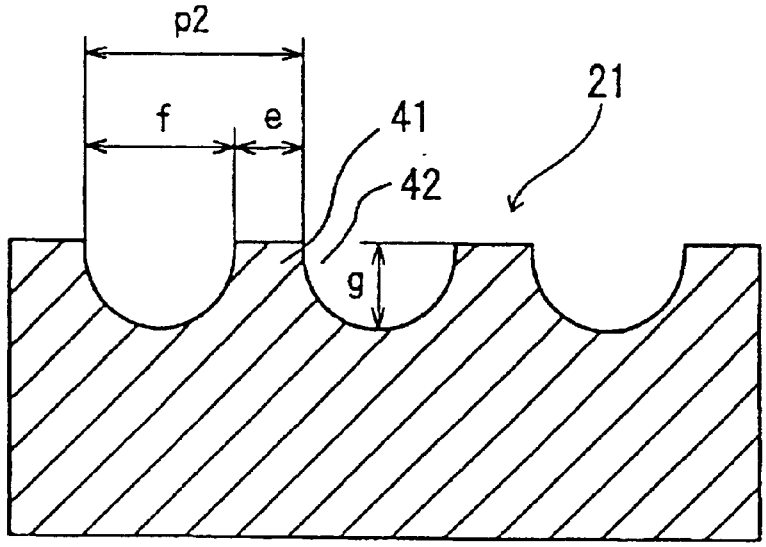
FIG. 9 illustrates an example of the sectional structure of the groove structure in a working configuration of the present invention.

FIG. 9 shows an enlarged sectional view of the recessed and projecting parts comprising a groove structure in the working surface part of the polishing body of Example 2-2 of the present invention. In the polishing body of Example 2-2, the sectional shape of the recessed parts (groove parts) 42 is a U shape; otherwise, this polishing body is similar to the polishing body of Example 2-1. Accordingly, a description of the parts that are similar to the polishing body of Example 2-1 will be omitted. In the polishing body of Example 2-2, e indicates the length of the top sides of the projecting parts 41, f indicates the length of the top sides of the recessed parts (groove parts) 42, and g indicates the depth of the grooves. Here, a periodic structure in the recessed and projecting parts facilitates manufacture, and is therefore desirable. In this case, p2 in FIG. 9 indicates the pitch of the periodic structure of the recesses and projections of the recessed and projecting parts (hereafter referred to as the "pitch of the grooves").

In the polishing body of Example 2-2 as in the polishing body of Example 2-1, the desirable range of the groove width f depends on the dimensions of the polishing debris or aggregated polishing particles discharged from the grooves. As a result of experiments, it was found that a range of 0.05 mm to 4.5 mm is desirable in the case of a silicon oxide type slurry.

With the groove width, which is limited as described above, thus being restricted, the pitch p2 of the grooves is determined by a tradeoff between the mutually conflicting characteristics of favorable fluidity of the polishing agent and size of the contact area. As a result of experiments, it was found that a value of 0. 1 mm to 5.0 mm is desirable. Furthermore, it was also found that a range of 0.0 mm to 3.0 mm is desirable for the length e of the top sides of the projecting parts of the grooves.

Furthermore, in cases where e=0, the top sides of the projecting parts have the form of an edge. However, under polishing conditions in which these edge-form projecting parts are pressed against the object of polishing, the edge portions are compressed, so that they contact the object of polishing with a finite area. Accordingly, even in cases where e=0, the effective contact area is not zero. The lower limit of the depth g of the grooves is determined by the discharge characteristics of polishing debris or aggregated polishing particles, and is preferably 0.1 mm or greater.

In Example 2-2, grooves in which the sectional shape of the recessed parts (groove parts) is a U shape are formed in the working surface part of the polishing body. If the grooves have a U shape, supply and discharge of the polishing agent are easy; furthermore, since the angles formed by the grooves and the working surface of the polishing body can be large, the generation of sharp-angled portions in the working surface of the polishing body can be suppressed. As a result, scratching of the object of polishing can be suppressed.

Furthermore, in the polishing body of Example 2-2, the sectional shape of the recessed parts (groove parts) formed in the working surface of the polishing body is set as a U shape; however, a shape with a curvature radius other than that of a U shape may also be used.

Figure 10:
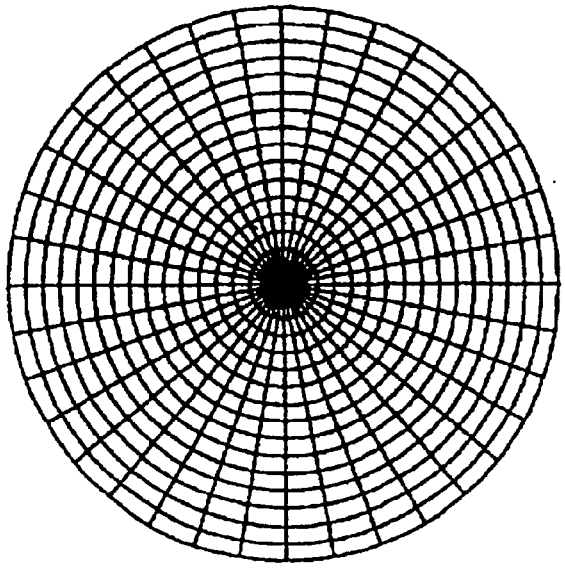
FIG. 10 is a diagram which shows an example of a groove structure combining concentric circular and radial grooves in an example of the present invention.
Figure 11:
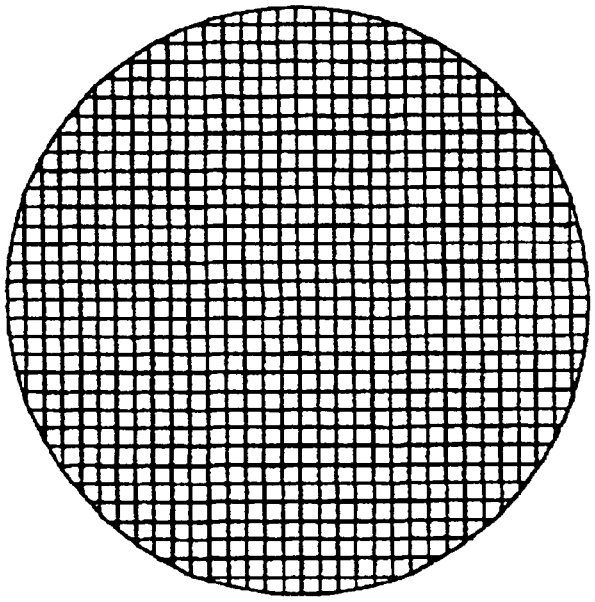
FIG. 11 is a diagram which shows an example of a groove structure with lattice-form grooves in an example of the present invention.
Figure 12:
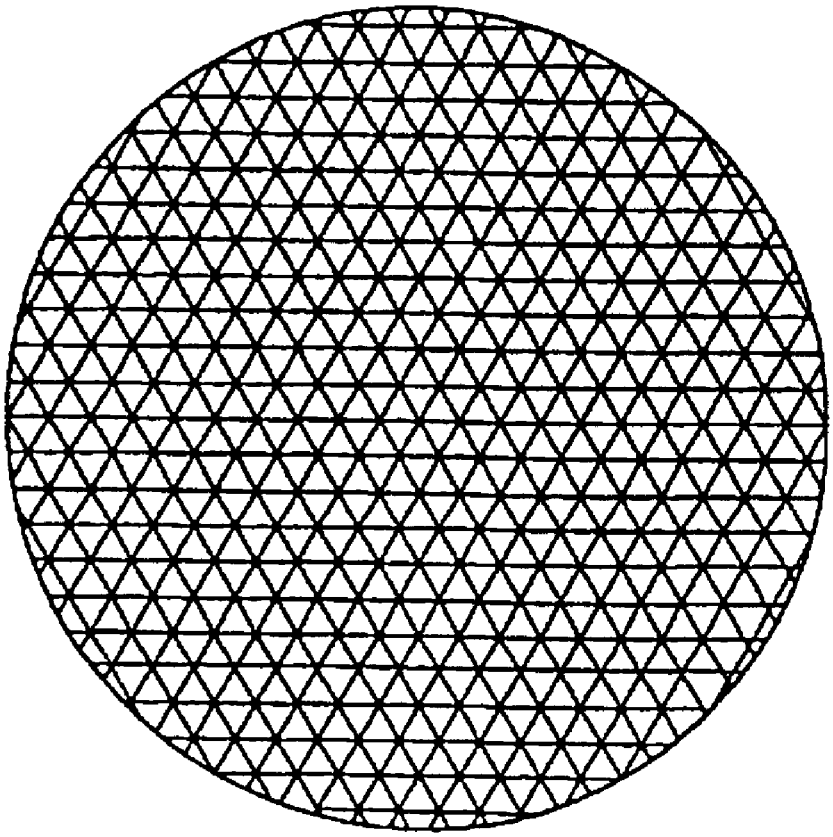
FIG. 12 is a diagram which shows an example of a groove structure with triangular lattice-form grooves in an example of the present invention.

In the polishing bodies of Examples 2-1 and 2-2, the shape of the grooves is important for increasing the polishing rate and eliminating scratches; accordingly, a pattern is selected which is suitable for maintaining the fluidity and retention of the polishing agent, and for effectively accomplishing the discharge of polishing debris or aggregated polishing particles. One pattern or a combination of two or more patterns selected from a set comprising concentric circular, spiral, lattice-form, triangular lattice-form and radial grooves is desirable as the above-mentioned pattern. Among these types of grooves, concentric circular and radial grooves are shown in FIG. 10, lattice-form grooves are shown in FIG. 11, and triangular lattice-form grooves are shown in FIG. 12 (all of these figures are plan views of the polishing body 21).

As was described above, the polishing rate is proportional to the contact area. However, contact between solids is generally a point contact. Since the non-foam polishing body of the present invention uses a hard material, the effective contact area is lower than a value that is simply calculated from the figures; accordingly, the polishing rate may also be lower than the expected value.

Figure 13:
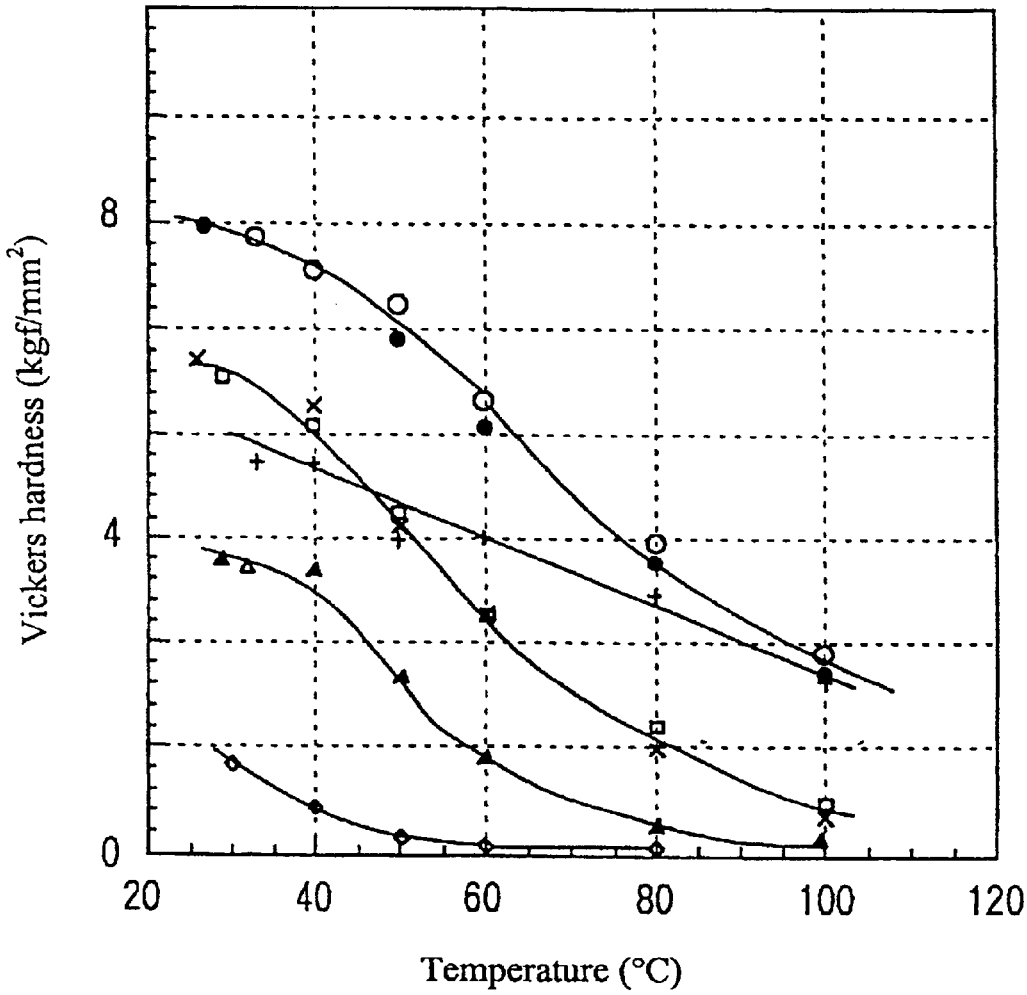
FIG. 13 is a graph which shows the relationship between the hardness of the polishing member and temperature.
Figure 14:
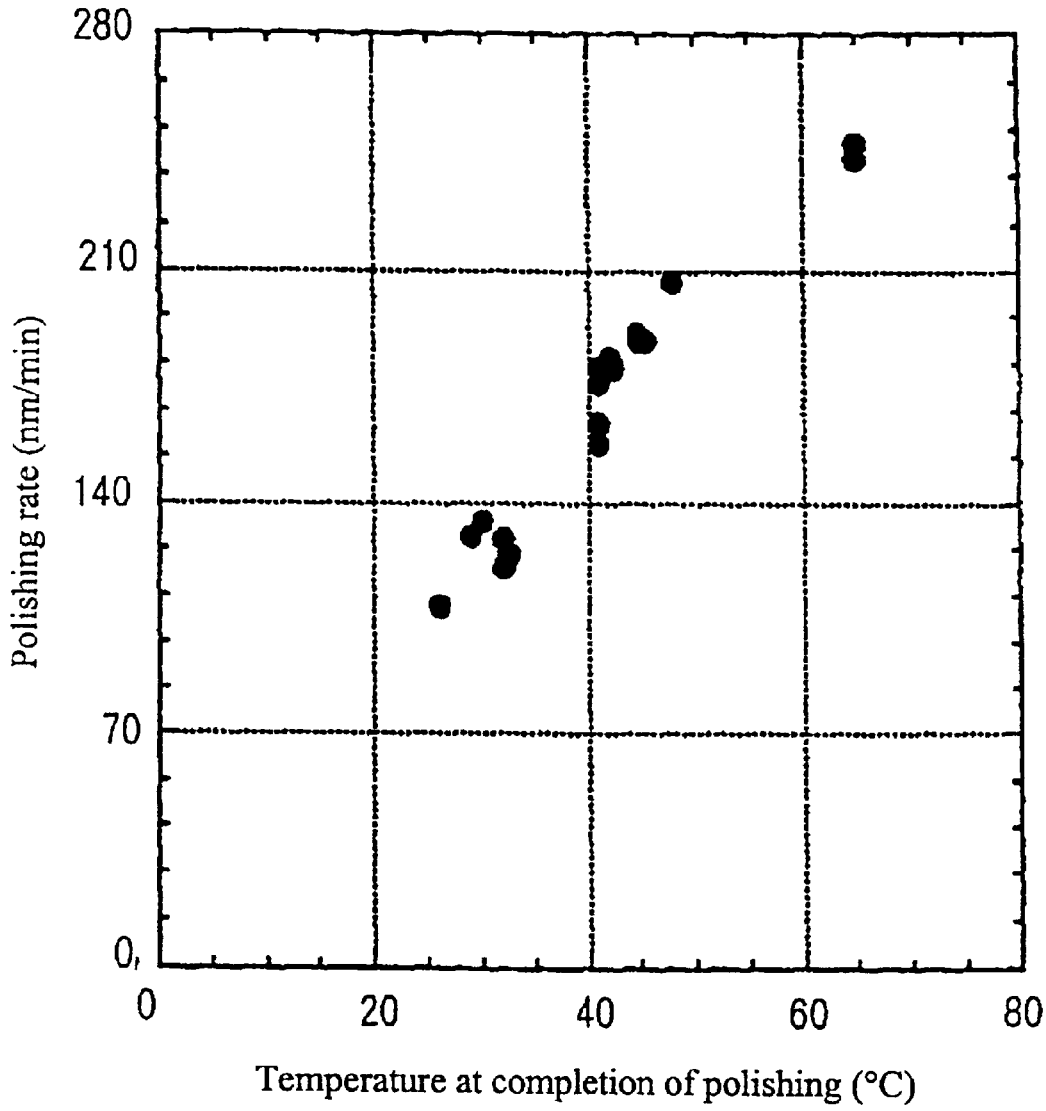
FIG. 14 is a graph which shows the relationship between the polishing rate and temperature.

Some device is needed in order to adapt the projecting parts as a whole to the object of polishing. Consequently, the temperature dependence of the hardness of the resin of the polishing pad material is utilized for this purpose. The hardness of the resin drops with a rise in temperature. The fit of the hardness of the polishing pad with respect to the object of polishing is improved by elevating the temperature or controlling the temperature. FIG. 13 shows how the hardness of the macromolecular polymer that constitutes the material of the polishing bodies of the embodiments of the present invention is caused to drop with an increase in temperature (the respective lines indicate the respective characteristics for different macromolecular polymers). As is shown in FIG. 14, the polishing rate depends on the temperature, and increases with an increase in the temperature. Causes of this increase in the polishing rate include an increase in the reactivity of the slurry in addition to an increase in the effective contact area.

On of the major special features of hard non-foam polishing bodies is smoothness, i.e., the fact that step differences in the pattern are efficiently eliminated. When the hardness of a polishing body drops, the step difference characteristics of this polishing body deteriorate. As is described below, an experiment was performed in order to investigate the relationship between the hardness of the polishing body and the step difference elimination characteristics. A silicon oxide ($SiO_2$) film with a thickness of 1 $\mu$m was formed on the surface of a 4 mm×4 mm pattern film with a thickness of 500 nm. When a wafer with an initial step difference of 500 nm was polished down 700 nm by means of polishing bodies in which the hardness of the material was varied, it was found that the residual step difference could be reduced to 150 nm or less in cases where the Vickers hardness of the material of the polishing body was 1.5 kgf/mm$^2$ (approximately $1.5\times10^7$ Pa) or greater, or in cases where the compressive Young's modulus was 25 kgf/mm$^2$ (approximately $2.5\times10^8$ Pa) or greater.

It is seen from these results that if the Vickers hardness can be maintained at a value of 1.5 kgf/mm$^2$ (approximately $1.5\times10^7$ Pa) or greater, or the compressive Young's modulus can be maintained at a value of 25 kgf/mm$^2$ (approximately $2.5\times10^8$ Pa) or greater, and polishing is performed under maximum temperature conditions, both the maximum polishing rate and good smoothness can be obtained.

In the above-mentioned polishing pad, holes can be bored in appropriate places in the groove structures shown in FIGS. 10, 11 and 12, thus forming measurement windows for the purpose of allowing the passage of measurement light in one or more places in order to allow the optical measurement of the polishing conditions during polishing in these places. Furthermore, it is desirable to apply a hard coating to the surface on the object of polishing side of the measurement windows in order to prevent scratching when the object of polishing and polishing head make contact, and it is also desirable to form an anti-reflection film on the surface located on the opposite side. Furthermore, if the polishing body of the present invention is attached to (for example) a conventional polishing apparatus of the type shown in FIG. 2, a polishing apparatus which has a high polishing rate, which is superior in terms of step difference elimination characteristics and which does not generate any scratching can be obtained.

Embodiment 2-1

Figure 15:
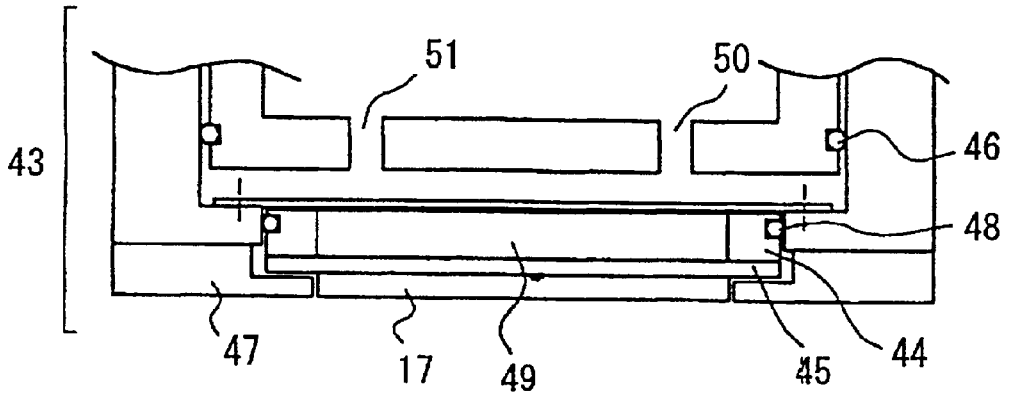
FIG. 15 is a schematic diagram of a polishing head constituting an embodiment of the present invention.

FIG. 15 is a schematic diagram which illustrates a polishing head that constitutes an embodiment of the present invention. In FIG. 15, 43 indicates the main part of the holding part (polishing head) that holds the object of polishing, 44 indicates an aluminum ring, 45 indicates an elastic film, 46 indicates an O-ring, 47 indicates a retainer ring, 48 indicates an O-ring, 49 indicates an airtight space, and 50 and 51 indicate high-pressure air inlet holes. A non-foam sheet comprising an epoxy resin with both a spiral-form V groove (groove pitch: 0.5 mm, length of top sides of projecting parts: 0.15 mm) and radial grooves (spaced at 5 degrees, depth: 0.5 mm) was fastened to the surface of an aluminum base plate with a diameter of 800 mm and a thickness of 20 mm, thus forming a polishing pad.

Next, the elastic film 45 (R201 manufactured by RODEL NITTA COMPANY) was bonded to the aluminum ring 44 (which had an internal diameter of 145 mm), and this ring 44 was mounted via the O-rings 46 and 48 as shown in FIG. 15, thus constructing the polishing head shown in FIG. 15. 47 is a retainer ring; this ring is used to prevent the object of polishing (silicon wafer) 17 from flying out. 49 is an airtight space which is maintained at a positive pressure in order to apply pressure to the object of polishing 17; a compressed gas is supplied via the high-pressure air inlet holes 50 and 51 in order to provide this positive pressure. As a result of this airtight space 49 and elastic film 45, a structure is formed which allows the application of pressure independently from the overall system including the retainer ring 47.

A six-inch silicon wafer 17 which had an $SiO_2$ thermal oxidation film formed on its surface to a thickness of 1 $\mu$m was fastened to the elastic film 45 by surface tension, and polishing was performed under the following working conditions:

Working Conditions

Polishing pad rpm: 50 rpm

Polishing head rpm: 50 rpm

Oscillation distance: 30 mm

Oscillation frequency: 15 reciprocating strokes per minute

Polishing agent: SEMI Supers 25 manufactured by Cabot Co., diluted 2X

Polishing agent flow rate: 50 m/min

Load on wafer: 400 g/cm2 ($3.9\times10^4$ Pa)

The temperature of the platen, and therefore the temperature of the polishing pad, was maintained at 50° C.

As a result of polishing under the above conditions, a polishing rate of 200 nm/min was obtained. Furthermore, when a silicon oxide ($SiO_2$) film with a thickness of 1 $\mu$m was formed on the surface of a 4 mm×4 mm pattern film with a thickness of 500 nm, and a wafer with an initial step difference of 500 nm was polished down by a thickness of 700 nm, the residual step difference was 100 nm or less, which was good. Moreover, no scratching occurred.

COMPARATIVE EXAMPLE 2-1

When the temperature of the polishing pad was set at room temperature, the residual step difference was good, i.e., 100 nm or less, as in the case of Embodiment 2-1; however, the polishing rate dropped to 150 nm/min. No scratching occurred.

COMPARATIVE EXAMPLE 2-2

Polishing was performed with the temperature of the polishing pad set at 50° C. using the same polishing pad as in Embodiment 2-1, except for the fact that the length of the top sides of the projecting parts of the grooves was increased to 0.35 mm. The polishing rate dropped to 180 nm/min from the 200 nm/min obtained in Embodiment 2-1. It is thought that the reason for this is that the fluidity of the polishing agent dropped. No scratching occurred.

Below, examples and embodiments of the present invention used in order to achieve the third aspect of the present invention will be described.

EXAMPLE 3-1

Figure 16:
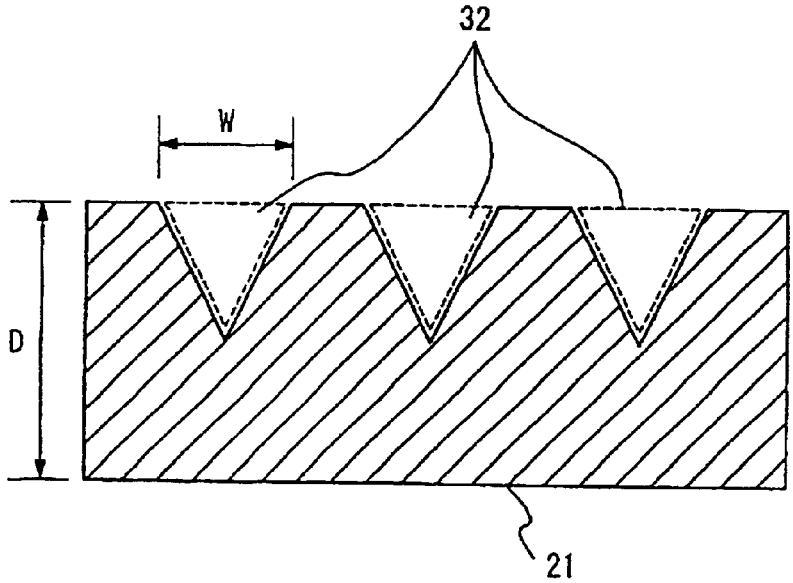
FIG. 16 is a sectional view of one portion of a polishing body constituting an example of the present invention.

The polishing body (polishing pad) 21 in the present example, which is shown in FIG. 16, is formed from a material in which the proportion of the void region caused by foaming is 20% or less relative to the volume of the polishing body 21 not including the region in which the grooves 32 are formed. A polishing body in which the above-mentioned void region caused by foaming is 0% is called a non-foam type polishing body. Furthermore, a polishing body in which the above-mentioned void region caused by foaming exceeds 0%, but is still relatively small, is called a low-foam type polishing body. Such non-foam type and low-foam type polishing bodies themselves have a low polishing agent retention capacity compared to foam type polishing bodies (polishing bodies in which the above-mentioned void region caused by foaming is relatively large). Accordingly, grooves 32 with a V-shaped sectional shape are formed in the surface of the polishing body 21.

Figure 2:
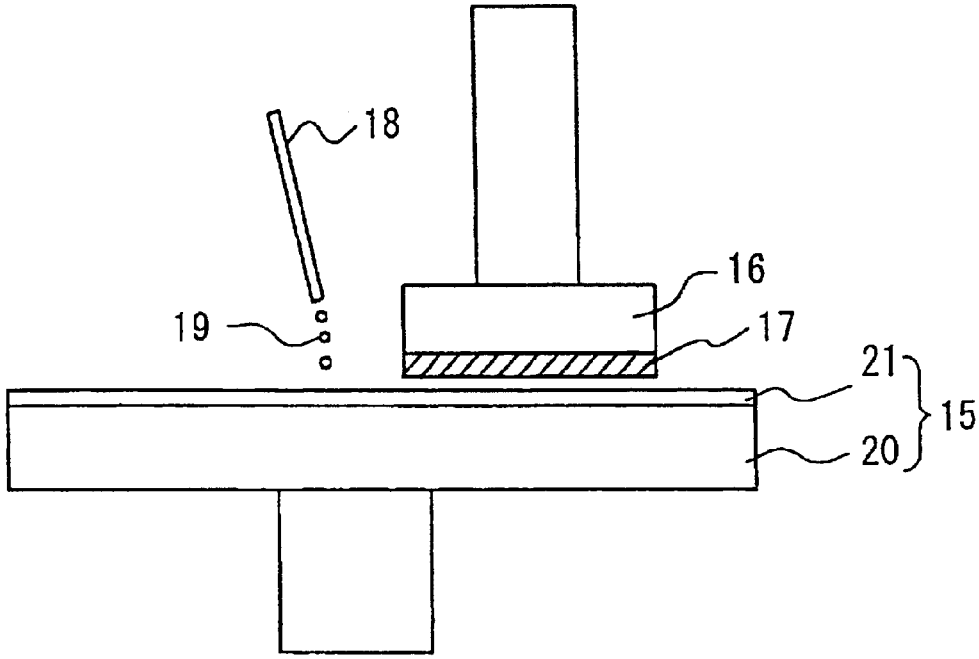
FIG. 2 is a schematic structural diagram of a CMP apparatus.

The polishing apparatus used in the present example has basically the same construction as the polishing apparatus shown in FIG. 2; this polishing apparatus differs from that shown in FIG. 2 only in that the polishing body shown as the present example is used as the polishing body (polishing pad) 21. Accordingly, this example will be described below with reference to FIG. 2.

The polishing body 21 is bonded to the polishing platen 20 by means of a two-sided tape or adhesive agent.

The silicon wafer 17 is held by the polishing head 16, and is caused to oscillate while being rotated. This wafer 17 is pressed against the polishing body 21 of the polishing member 15 with a specified pressure. The polishing member 15 is also rotated, so that a relative motion is performed between the polishing member 15 and the silicon wafer 17. In this state, a polishing agent 19 is supplied to the surface of the polishing body 21 from a polishing agent supply part 18. The polishing agent 19 diffuses over the surface of the polishing body 21, and enters the space between the polishing body 21 and the silicon wafer 17 as a relative motion is performed between the polishing member 15 and silicon wafer 17, so that the surface of the silicon wafer 17 that is to be polished is polished. Specifically, favorable polishing is performed as a result of a synergistic effect of mechanical polishing caused by the relative motion of the polishing member 15 and silicon wafer 17, and the chemical action of the polishing agent 19.

Figure 17A:
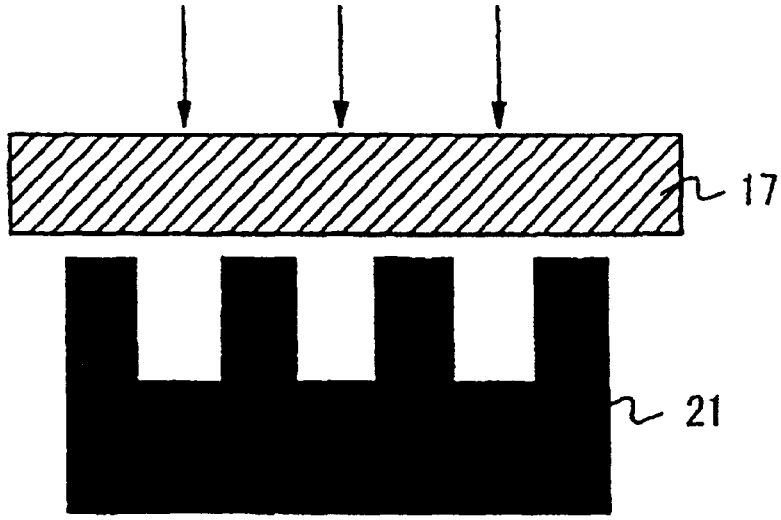
FIGS. 17A and 17B show sectional views that illustrate the state of the polishing body when a load is applied.
Figure 17B:
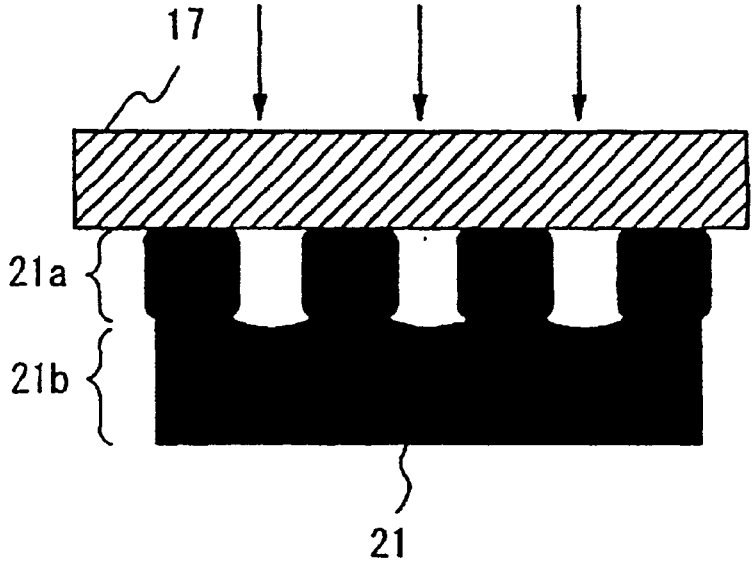

FIG. 17 comprises sectional views showing a portion of the polishing body in a state in which a load is applied by the object of polishing. In FIGS. 17A and 17B, the sectional shape of the grooves formed in the surface of the polishing body 21 is rectangular. FIG. 17A shows a state in which no load is applied by the object of polishing 17, while FIG. 17B shows a state in which a load is applied by the object of polishing 17. In the case of a polishing body which has grooves formed in its surface, elastic deformation occurs in the polishing body as a whole when a load is applied. However, when the polishing body 21 is divided into a region 21*a* extending from the surface of the polishing body 21 to the bottoms of the grooves, and a bulk region 21*b* of the polishing body corresponding to the lower layer in which no grooves are formed, elastic deformation occurs to a greater extent in the region 21*a* in which grooves are formed, where the load per unit area is greater, as is shown in FIG. 17B. This deformation is greater in cases where the width of the projecting portions between the grooves is narrow, and in cases where the grooves are deep. Conversely, the deformation of the groove region 21*a* is smaller in cases where the width of the projecting portions between the grooves is large, or in cases where the grooves are shallow. The polishing characteristics vary greatly according to the amount of deformation of the region 21*a* in which these grooves are formed. Specifically, if the amount of deformation is large, this improves the uniformity that is a special feature of soft polishing bodies; on the other hand, if the amount of deformation is small, this improves the smoothness that is a special feature of hard polishing bodies.

In cases where the width W of the grooves 32 in the surface of the polishing body (FIG. 16) is less than 0.1 mm, it is difficult to form the grooves while maintaining the precision of the groove dimensions in the manufacture of the polishing body. Furthermore, it also becomes difficult to clean out the polishing agent that has entered the interiors of the grooves 32; this polishing agent adheres to the interiors of the grooves 32, so that scratches may be formed during polishing in the polished surface of the silicon wafer by the resulting debris. On the other hand, in cases where the width W of the grooves 32 in the surface of the polishing body is greater than 2.0 mm, the area of contact with the object of polishing via the polishing agent is reduced, so that the heat generated by the contact resistance between the polishing body and the object of polishing is reduced; consequently, the chemical element of the CMP loses its effect, so that the polishing rate drops conspicuously. Accordingly, it is desirable that the width W of the grooves 32 at the surface of the polishing body be such that $0.1\ \text{mm} \leqq W \leqq 2.0\ \text{mm}$.

Furthermore, in cases where the ratio VL of the volume of the region in which the grooves 32 are formed to the volume of the polishing body 21 including the region in which the grooves 32 are formed is less than 0.1%, the polishing liquid retention capacity at the surface of the polishing body 21 drops; as a result, the polishing rate drops conspicuously, and the uniformity deteriorates. Furthermore, the amount of deformation of the polishing body is reduced, so that the uniformity deteriorates in this respect as well. On the other hand, in cases where the above-mentioned ratio VL exceeds 30%, the amount of deformation of the polishing body becomes large, so that the smoothness deteriorates. Accordingly, it is desirable that the above-mentioned ratio VL be such that $0.1\% \leqq VL \leqq 30\%$.

Thus, in the case of a polishing apparatus of the above-mentioned type using a polishing body of the above-mentioned type, since the material of the polishing body is a non-foam type or low-foam type material, the amount of wear caused by use of the polishing body is extremely small; furthermore, dressing is either unnecessary or can be performed in a short time. Thus, since there is no change in the groove structure due to wear, stable polishing characteristics can be obtained at all times. Consequently, the frequency with which the polishing body must be replaced is reduced, so that the cost of polishing can be reduced. Furthermore, among the polishing characteristics, the uniformity, smoothness and polishing rate can be controlled by means of the groove structure formed in the surface (groove width W and volume ratio VL); accordingly, a groove structure can be selected so that ideal polishing characteristics are obtained. As a result, the polishing yield can be increased and the time required for polishing can be shortened, so that the cost of polishing can be reduced.

Furthermore, in this example, the sectional shape of the grooves 32 was a V shape; however, some other shape could also be used.

EXAMPLE 3-2

In the polishing body of this example, the thickness D (FIG. 16) is in the following range: $0.5\ \text{mm} \leqq D \leqq 5.0\ \text{mm}$. Otherwise, this polishing body is the same as the polishing body of Example 3-1; accordingly, a further description is omitted. Furthermore, the polishing apparatus used is the same as the polishing apparatus of Example 3-1.

If the thickness D of the polishing body 21 is greater than 5.0 mm, the absolute amount of deformation of the polishing body increases, so that the smoothness deteriorates. On the other hand, if the thickness D of the polishing body 21 is less then 0.5 mm, the absolute amount of deformation of the polishing body decreases, so that the uniformity deteriorates. Accordingly, it is desirable that the thickness D be set so that $0.5\ \text{mm} \leqq D \leqq 5.0\ \text{mm}$.

Thus, in a polishing apparatus using the polishing body of this example, the uniformity, smoothness and polishing rate (among the polishing characteristics) can be controlled by means of the thickness D of the polishing body; accordingly, the thickness of the polishing body can be selected so that ideal polishing characteristics are obtained. As a result, the polishing yield can be increased and the time required for polishing can be shortened, so that the cost of polishing can be reduced.

EXAMPLE 3-3

In the polishing body of this example, the depth of the grooves 32 is no more than three times the width W of the grooves at the surface of the polishing body (FIG. 16). Otherwise, this polishing body is the same as the polishing body of Example 3-1 or 3-2; accordingly, a further description is omitted. Furthermore, the polishing apparatus used is the same as the polishing apparatus of Example 3-1.

If the depth of the grooves 32 is greater than three times the width W of the grooves 32 at the surface of the polishing body 21, it becomes difficult to remove the polishing agent from the interiors of the grooves of the polishing body; as a result, the polishing agent adheres to the interiors of the grooves, and in cases where this adhering matter comes loose, a possibility of generating scratches in the polished surface of the object of polishing is high. Accordingly, it is desirable that the depth of the grooves 32 be no more than three times the width W of the grooves at the surface of the polishing body.

Thus, in the case of a polishing apparatus using the polishing body of the present example, there is no scratching of the polished surface of the object of polishing. As a result, the polishing yield can be increased, and the cost of polishing can be reduced.

EXAMPLE 3-4

Figure 18:
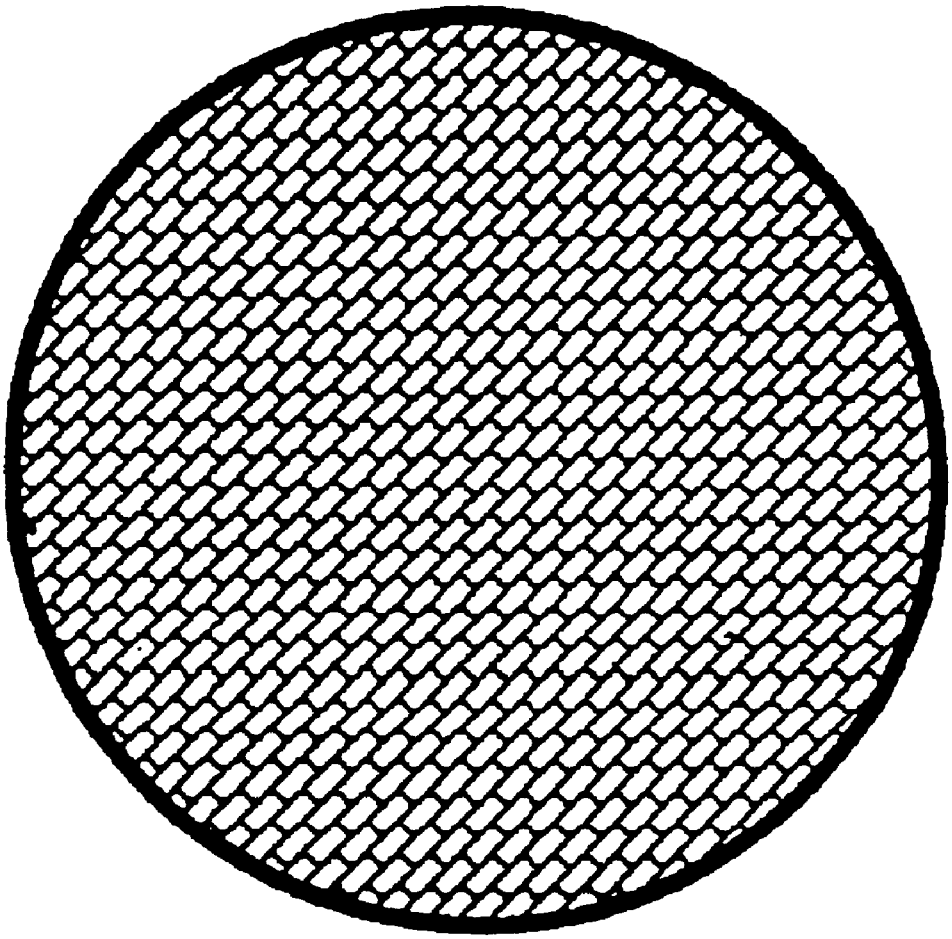
FIG. 18 is a plan view which shows an example of the schematic construction of the polishing body.

FIG. 18 is a schematic structural diagram (plan view) of the polishing body of the present example. In the polishing body of the present example, the shape of the grooves with respect to the surface of the polishing body is a "knitted" shape. If the shape of the grooves with respect to the surface of the polishing body is a "knitted" shape, the polishing agent can be stably supplied; furthermore, the polishing agent on the polishing body tends not to fly off the polishing body as a result of the centrifugal force arising from the rotation of the polishing platen; accordingly, the polishing agent retention capacity on the surface of the polishing body can be improved. Consequently, it is desirable that the shape of the grooves with respect to the surface of the polishing body be a "knitted" shape. Otherwise, this polishing body is the same as the polishing bodies of the above-mentioned Examples 3-1, 3-2 and 3-3; accordingly, a further description is omitted.

Furthermore, in the polishing body of the above example, the shape of the grooves with respect to the surface of the polishing body was a "knitted" shape; however, it would also be possible to use a spiral shape, concentric circular shape, lattice shape, triangular lattice shape or random shape, or a shape that includes two or more shapes selected from a set comprising the above-mentioned shapes and a "knitted" shape.

In the case of a polishing apparatus using a polishing body which has such a groove shape, the polishing agent retention capacity at the surface of the polishing body is high; accordingly, the polishing rate is increased, and the uniformity is also improved. As a result, the polishing yield is increased, and the time required for polishing is shortened, so that the cost of polishing can be reduced.

EXAMPLE 3-5

Figure 19A:
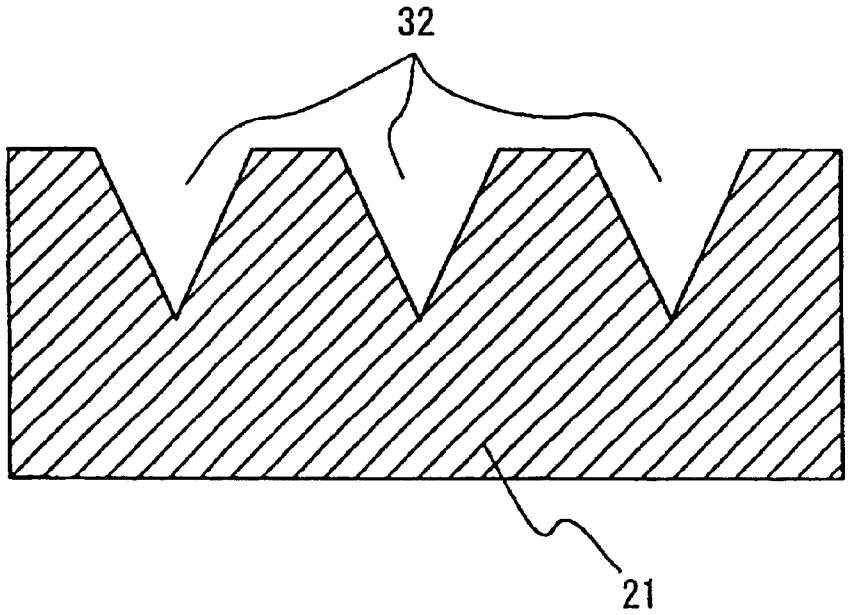
FIGS. 19A and 19B show sectional views of a polishing body which constitutes an example of the present invention.
Figure 19B:
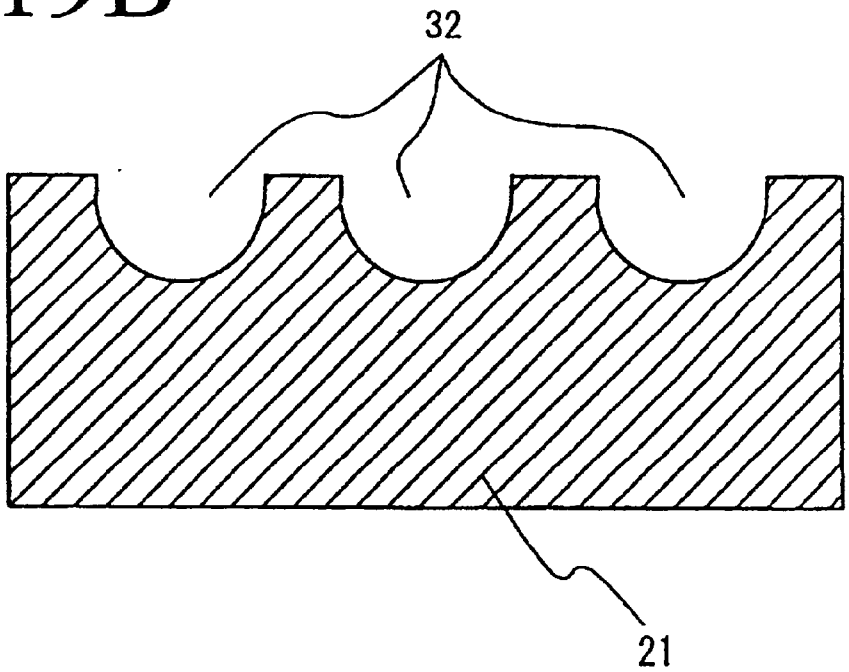

FIG. 19 shows sectional views of the polishing bodies used in the present example. FIG. 19(*a*) shows a polishing body in which the sectional shape of the grooves 32 is a V shape, while FIG. 19(*b*) shows a polishing body in which the sectional shape of the grooves 32 is a U shape. In the case of FIG. 19(*a*), grooves 32 whose sectional shape is a V shape are formed in the surface of the polishing body 21. In the case of FIG. 19(*b*), grooves 32 whose sectional shape is a U shape are formed in the surface of the polishing body 21. If the grooves have such sectional shapes, the supply and discharge of the polishing agent are facilitated; furthermore, since the angles formed by the surface of the polishing body and the grooves are large angels, the generation of sharp-angled portions in the surface of the polishing body can be suppressed. As a result, scratching of the polished surface of the silicon wafer can be suppressed.

The remaining construction of the polishing body 21 is similar to the constructions of the polishing bodies of Examples 3-1 through 3-4; accordingly, further description is omitted here.

Furthermore, in the polishing body of the present example, the sectional shape of the grooves formed in the surface of the polishing body was a V shape or U shape; however, it would also be possible to use a shape with a curvature other than a U shape, or to use a rectangular or polygonal shape.

In the case of a polishing apparatus which uses such a polishing body, there is no scratching of the object of polishing. Accordingly, the polishing yield can be increased, and the cost of polishing can be reduced.

EXAMPLE 3-6

In the polishing body of the present example, the compressive elastic modulus K of the material is such that 0.1 GPa≦K≦2.0 GPa. The remaining construction is the same as the constructions of the polishing bodies of Examples 3-1 through 3-5; accordingly, further description is omitted here.

In the present example, since the material is not too soft, there is little wear during polishing, so that the polishing body has a long useful life; moreover, there is no deterioration in the smoothness. Furthermore, since the material is not too hard, there is no scratching of the object of polishing, and no deterioration in the uniformity.

In the case of a polishing apparatus using such a polishing body of the present example, in which the polishing body is formed from a material whose compressive elastic modulus K is such that 0.1 GPa≦K≦2.0 GPa, the polishing yield can be increased, and the cost of polishing can be reduced.

EXAMPLE 3-7

In the polishing body of the present example, the main component of the material of the polishing body comprises one or more resins selected from a set comprising epoxy resins, acrylic resins, polyester resins, vinyl chloride resins, polycarbonate resins and non-foam urethane resins. A polishing body which chiefly comprises these materials shows little wear caused by polishing.

In the case of a polishing apparatus using such a polishing body, there is little wear of the polishing body due to polishing; accordingly, the useful life of the polishing body is extended. As a result, the frequency with which the polishing body is replaced is reduced, so that the cost of polishing can be reduced.

EXAMPLE 3-8

Grooves that supply and discharge the polishing agent are further formed in the surface of the polishing body of the present example. As a result, the polishing agent is uniformly supplied to the entire surface of the object of polishing. Furthermore, it is desirable that the sectional shape of the above-mentioned grooves that supply and discharge the polishing agent be a shape that has a curvature, a rectangular shape, a V shape or a polygonal shape. Furthermore, it is desirable that the shape of the grooves (which supply and discharge the above-mentioned polishing agent) with respect to the surface of the polishing body be a radial shape, lattice shape, triangular lattice shape, "knitted" shape or random shape.

Moreover, portions of the grooves formed in the polishing body in the respective examples described above may be used as the above-mentioned grooves that supply and discharge the polishing agent, or new grooves that are different from the above-mentioned grooves may be formed.

In a polishing apparatus which uses such a polishing body, the polishing agent is uniformly supplied to the entire polished surface of the object of polishing; accordingly, there is no deterioration in the uniformity, and no deterioration in the polishing characteristics due to an increase in friction between the object of polishing and the polishing body. As a result, the polishing yield is increased, and the cost of polishing can be reduced.

EXAMPLE 3-9

In the present example, there is a transparent region in a portion of the polishing body.

Figure 20:
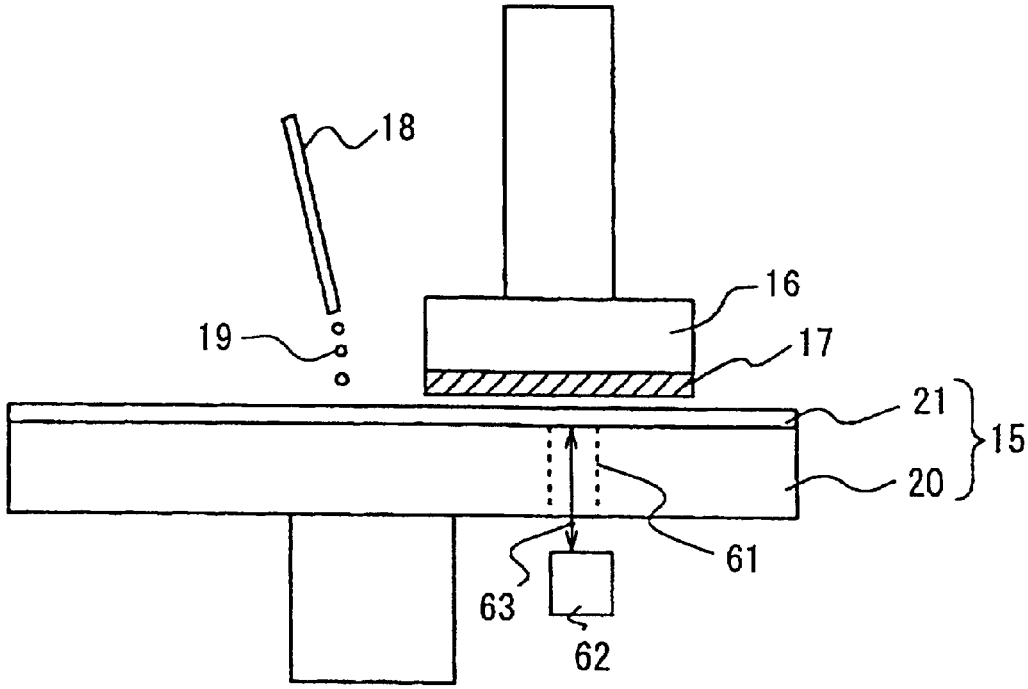
FIG. 20 is a schematic structural diagram of a CMP apparatus constituting an example of the present invention.

FIG. 20 is a schematic structural diagram of the polishing apparatus of the present example. In FIG. 20, 61 indicates an opening part, 62 indicates a polishing process measuring device, and 63 indicates measurement light. The basic construction of the polishing apparatus shown in FIG. 20 is the same as that of the apparatus shown in FIG. 2; accordingly, only the parts that are different will be described. The opening part 61 is formed in a polishing platen 20. Furthermore, the polishing process measuring device 62 that measures the polishing process (e.g., the thickness of the silicon wafer) by optically observing the polishing conditions is installed beneath the polishing platen 20. A transparent region (not shown in the figures) is formed in the polishing body 21, which is disposed on the polishing platen 20, and the apparatus is arranged so that this transparent region and the opening part 61 in the polishing platen 20 are superimposed. Accordingly, the measurement light 63 that is emitted from the polishing process measuring device 62 passes through the above-mentioned opening part 61 and the transparent region of the polishing body 21, and is reflected by the silicon wafer; this light then again passes through the transparent region of the polishing body 21 and the opening part 61, and returns to the polishing process measuring device 62, where the light is detected. In this way, the progress of the polishing is measured.

It is desirable to use a device that detects the polishing endpoint and measures the film thickness from the reflected spectroscopic characteristics (reflected spectroscopic spectrum) as the above-mentioned polishing process measuring device 62 that optically observes the polishing conditions and measures the polishing process. The reflected spectroscopic spectrum that is measured by the polishing process measuring device 62 that observes the conditions of the polished surface is compared by a computer (not shown in the figures) with a reference spectrum obtained by simulation, etc., and the film thickness is calculated, or the polishing endpoint is detected. Furthermore, instead of a device that detects the polishing endpoint and measures the film thickness from the above-mentioned reflected spectroscopic characteristics (reflected spectroscopic spectrum), it would also be possible to use a device that detects the polishing endpoint or measures the film thickness from the variation in the reflectivity at a specified wavelength, or a device that detects the polishing endpoint or measures the film thickness by performing image processing on images obtained by imaging the polished surface with a CCD camera, etc., as the polishing process measuring device 62 that observes the conditions of the polished surface.

Thus, in the polishing apparatus of the present example, the polished state of the polished surface of the object of polishing can be detected in situ during the polishing process by means of a device that observes the polished state via an opening part formed in the polishing platen and a transparent region of the polishing body. As a result, the polishing endpoint can be detected during the polishing process; accordingly, the polishing yield can be increased, and the cost of polishing can be reduced.

In the respective Examples 3-1 through 3-9 described above, the polishing characteristics can be controlled by setting the groove structure and thickness of the polishing body as follows within the ranges stipulated in the present invention:

Specifically, the uniformity can be increased by increasing the depth of the grooves and increasing the thickness of the polishing body. Furthermore, the smoothness can be increased by reducing the depth of the grooves and reducing the thickness of the polishing body. Moreover, the polishing rate can be increased by increasing the width of the projecting parts between the grooves of the polishing body.

Furthermore, the method that is used to form grooves in the surface of the polishing bodies of the respective examples described above may be a universally known method, e.g., a method in which the surface of the polishing body is milled using a groove working bit, etc.

Embodiment 3-1

A non-foam polishing body comprising an epoxy resin with a groove structure was bonded to the surface of the polishing platen of a polishing apparatus by means of a two-sided tape. The compressive elastic modulus of this epoxy resin was 0.98 GPa. A V-shaped groove with a groove width W of 0.35 mm, an inter-groove projecting part width of 0.15 mm and a depth of 0.30 mm was formed in a spiral configuration in the surface of the polishing body of Embodiment 3-1. The thickness of the polishing body was 4.0 mm, and the ratio VL of the volume of the region in which the above-mentioned grooves were formed to the volume of the polishing body including the region in which the grooves were formed was 2.6%.

A six-inch silicon wafer on which a thermal oxidation film was formed to a thickness of 1 $\mu$m was attached to the polishing head via a backing material, and polishing was performed for 150 seconds under the following conditions:

Polishing head rpm: 50 rpm

Polishing platen rpm: 50 rpm

Load on polishing head: $3.92\times10^4$ Pa

Oscillation width of polishing head: 30 mm

Oscillation rate of polishing head: 15 reciprocating strokes per minute

Polishing agent used: SS 25 manufactured by Cabot Co., diluted 2X with ion exchange water Polishing agent flow rate: 200 ml/min Furthermore, a silicon wafer with a plasma TEOS (tetraethoxysilane) film pattern was polished under the above-mentioned conditions. The pattern portions of this patterned silicon wafer comprised a 1.5-$\mu$m plasma TEOS film, and the non-pattern portions comprised a 1.0-$\mu$m plasma TEOS film, so that a step difference of 0.5 $\mu$m was present as the initial step difference. A 4.0 mm square pattern was disposed in two dimensions within the silicon wafer. This film was polished until the non-pattern portion reached a thickness of 0.8 $\mu$m.

Embodiment 3-2

The same objects of polishing as those used in Embodiment 3-1 (a six-inch silicon wafer on which a thermal oxidation film was formed to a thickness of 1 $\mu$m, and a silicon wafer with a plasma TEOS film pattern) were polished using a non-foam polishing body comprising an epoxy resin with a groove structure in the surface. A V-shaped groove with a groove width W of 0.25 mm, an inter-groove projecting part width of 0.25 mm and a depth of 0.25 mm was formed in a spiral configuration in the surface of this polishing body. The thickness of the polishing body was 4.0 mm, and the ratio VL of the volume of the region in which the above-mentioned grooves were formed to the volume of the polishing body including the region in which the grooves were formed was 1.6%. The polishing conditions were exactly the same conditions as in Embodiment 3-1.

Embodiment 3-3

The same objects of polishing as those used in Embodiment 3-1 (a six-inch silicon wafer on which a thermal oxidation film was formed to a thickness of 1 $\mu$m, and a silicon wafer with a plasma TEOS film pattern) were polished using a non-foam polishing body comprising an epoxy resin with a groove structure in the surface. A V-shaped groove with a groove width W of 0.25 mm, an inter-groove projecting part width of 0.25 mm and a depth of 0.25 mm was formed in a spiral configuration in the surface of this polishing body. The thickness of the polishing body was 2.0 mm, and the ratio VL of the volume of the region in which the above-mentioned grooves were formed to the volume of the polishing body including the region in which the grooves were formed was 3.1 %. The polishing conditions were exactly the same conditions as in Embodiment 3-1.

Embodiment 3-4

1000 six-inch silicon wafers on which a thermal oxidation film had been formed to a thickness of 1 μm were polished using the polishing body of Embodiment 3-3, after which the same objects of polishing as those polished in Embodiment 3-1 (a six-inch silicon wafer on which a thermal oxidation film was formed to a thickness of 1 μm, and a silicon wafer with a plasma TEOS film pattern) were polished. In this polishing, no dressing was performed either before or during polishing. The polishing conditions were exactly the same conditions as in Embodiment 3-1.

Embodiment 3-5

The same objects of polishing as those used in Embodiment 3-1 (a six-inch silicon wafer on which a thermal oxidation film was formed to a thickness of 1 μm, and a silicon wafer with a plasma TEOS film pattern) were polished using a non-foam polishing body comprising an epoxy resin with a groove structure in the surface. U-shaped grooves with a groove width W of 0.25 mm, an inter-groove projecting part width of 0.25 mm and a depth of 0.25 mm were formed in a "knitted" configuration in the surface of this polishing body. The thickness of the polishing body was 4.0 mm, and the ratio VL of the volume of the region in which the above-mentioned grooves were formed to the volume of the polishing body including the region in which the grooves were formed was 5.2%. The polishing conditions were exactly the same conditions as in Embodiment 3-1.

COMPARATIVE EXAMPLE 3-1

The same objects of polishing as those used in Embodiment 3-1 (a six-inch silicon wafer on which a thermal oxidation film was formed to a thickness of 1 μm, and a silicon wafer with a plasma TEOS film pattern) were polished using a non-foam polishing body comprising an epoxy resin with a groove structure in the surface. A rectangular groove with a groove width W of 0.05 mm, an inter-groove projecting part width of 0.45 mm and a depth of 2.0 mm was formed in a spiral configuration in the surface of this polishing body. The thickness of the polishing body was 4.0 mm, and the ratio VL of the volume of the region in which the above-mentioned grooves were formed to the volume of the polishing body including the region in which the grooves were formed was 5.0%. The polishing conditions were exactly the same conditions as in Embodiment 3-1.

COMPARATIVE EXAMPLE 3-2

The same objects of polishing as those used in Embodiment 3-1 (a six-inch silicon wafer on which a thermal oxidation film was formed to a thickness of 1 μm, and a silicon wafer with a plasma TEOS film pattern) were polished using a non-foam polishing body comprising an epoxy resin with a groove structure in the surface. A rectangular groove with a groove width W of 0.45 mm, an inter-groove projecting part width of 0.05 mm and a depth of 2.0 mm was formed in a spiral configuration in the surface of the polishing body of Comparative Example 3-2. The thickness of the polishing body was 4.0 mm, and the ratio VL of the volume of the region in which the above-mentioned grooves were formed to the volume of the polishing body including the region in which the grooves were formed was 45.0%. The polishing conditions were exactly the same conditions as in Embodiment 3-1.

For the above-mentioned embodiments and comparative examples, the polishing rate, uniformity and smoothness were measured using the respective objects of polishing after polishing was completed. The polishing rate was calculated from the polishing time and the mean amount of polishing of the six-inch silicon wafer on which a thermal oxidation film had been formed to a thickness of 1 μm (excluding a portion extending 5 mm inward from the edge of the wafer). The uniformity was calculated using the following formula from the polishing amount profile of the six-inch silicon wafer on which a thermal oxidation film had been formed to a thickness of 1 μm (excluding a portion extending 5 mm inward from the edge of the wafer):

$$\text{Uniformity } (\%) = (RA - RI)/(RA + RI) \times 100 \quad (2)$$

Here, RA is the maximum amount of polishing in the measured polishing amount profile, and RI is the minimum amount of polishing in the measured polishing amount profile. Furthermore, the smoothness was evaluated as follows: using the above-mentioned six-inch silicon wafer with a plasma TEOS film pattern, the non-pattern portion was polished to a thickness of 0.8 μm, and the residual step difference in this case was measured at a plurality of locations within the silicon wafer; then, the maximum value among the measured values of these residual step differences was taken as the smoothness.

The groove structures and thicknesses of the above-mentioned embodiments and comparative examples are shown along with the results of the above-mentioned measurements in Table 1 (Embodiment 3-1 is indicated as Embodiment 1, and Comparative Example 3-1 is indicated as Comparative Example 1, etc.).

TABLE 1

| | Embodiment 1 | Embodiment 2 | Embodiment 3 | Embodiment 4 | Embodiment 5 | Comparative Example 1 | Comparative Example 2 |
|---|---|---|---|---|---|---|---|
| Groove width W (mm) | 0.35 | 0.25 | 0.25 | 0.25 | 0.25 | 0.05 | 0.45 |
| Width of projecting parts between grooves (mm) | 0.15 | 0.25 | 0.25 | 0.25 | 0.25 | 0.45 | 0.05 |

TABLE 1-continued

| | Embodiment 1 | Embodiment 2 | Embodiment 3 | Embodiment 4 | Embodiment 5 | Comparative Example 1 | Comparative Example 2 |
|---|---|---|---|---|---|---|---|
| Groove depth (mm) | 0.30 | 0.25 | 0.25 | 0.25 | 0.25 | 2.0 | 2.0 |
| Sectional shape of grooves | V shape | V shape | V shape | V shape | U shape | Rectangular | Rectangular |
| Shape of grooves with respect to the surface of the polishing body | Spiral | Spiral | Spiral | Spiral | "Knitted" shape | Spiral | Spiral |
| Depth D (mm) | 4.0 | 4.0 | 2.0 | 2.0 | 4.0 | 4.0 | 4.0 |
| Volume ratio VL (%) | 2.6 | 1.6 | 3.1 | 3.1 | 5.2 | 5.0 | 45.0 |
| Polishing rate (nm/min) | 212 | 256 | 252 | 255 | 254 | 160 | 150 |
| Uniformity (%) | 8.8 | 10.5 | 11.9 | 12.0 | 8.0 | 25.0 | 20.0 |
| Smoothness (nm) | 80 | 35 | 20 | 20 | 35 | 50 | 100 |

As is shown above, a great difference was seen in the polishing characteristics as a result of the stipulation of the groove structure and thickness of the polishing body according to the present invention, in spite of the fact that the material of the polishing body was exactly the same in each case.

Embodiment 3-1 and Embodiment 3-2 differ only in terms of the groove structure; the uniformity is superior in the case of Embodiment 3-1, in which the width of the grooves is large and the grooves are deep, while the smoothness is superior in the case of Embodiment 3-2, in which the opposite is true. As was described above, the cause of this difference is the difference in the apparent elastic modulus of the region in which the grooves are formed. In regard to the polishing rate as well, a large increase is seen in Embodiment 3-2, in which the width of the projecting parts between the grooves is large.

In regard to Embodiment 3-2 and Embodiment 3-3, the groove structure is the same, and the thickness of the polishing body is different. The uniformity is superior in the case of Embodiment 3-2, while the smoothness is superior in the case of Embodiment 3-3. In these examples as well, the cause of the difference is a difference in the absolute amount of deformation during polishing resulting from a difference in the thickness of the respective polishing bodies.

In regard to Embodiment 3-3 and Embodiment 3-4, respective evaluations were made before continuous polishing and after continuous polishing. These results indicate that in the case of the polishing body of the present invention, the polishing characteristics are not changed by continuous polishing, in spite of the fact that no dressing process is performed for each polishing operation.

In the case of Embodiment 3-5 and Embodiment 3-2, a polishing body in which the shape of the grooves formed in the surface of the polishing body is a "knitted" shape and a polishing body in which the groove shape is a spiral shape are compared. These examples show that the "knitted" structure of Embodiment 3-5, which has a superior polishing agent supply and discharge capacity, is superior.

Comparative Example 3-1 and Comparative Example 3-2 have groove structures that depart from the claims of the present invention. In the case of Comparative Example 3-1, the width between the grooves is large, so that the polishing agent cannot be sufficiently supplied; as a result, the polishing efficiency is poor. Furthermore, in the case of Comparative Example 3-2, the width between the grooves is extremely small; as a result, the contact area during polishing is small, so that the polishing efficiency is inferior. Furthermore, in both of these examples, there was a tendency toward extremely severe scratching of the polished surface of the silicon wafer during polishing.

Below, examples and embodiments of the present invention which are used in order to achieve the fourth aspect of the present invention will be described.

EXAMPLE 4-1

FIGS. 21A and 21B are diagrams which illustrate the polishing body of the present example. FIG. 21B is a plan view, and FIG. 21B is a sectional view of the portion indicated by line A–A' in FIG. 21A (furthermore, the sectional view indicates that there are two types of sections with different shapes; the positions of the sections do not accurately correspond to the positions of A and A').

The plan shape of the polishing body of the present example is a circular shape, and two types of recessed and projecting structures are formed in the surface of this polishing body. Here, the two types of recessed and projecting structures will be referred to respectively as the "first recessed and projecting structure" and the "second recessed and projecting structure". As is shown in FIG. 21A, regions which have the first recessed and projecting structure (i.e., the black portions of FIG. 21A) and regions which have the second recessed and projecting structure (i.e., the white portions of FIG. 21A) are disposed in the form of concentric circles on the surface of the polishing body. Regions in which the first recessed and projecting structure is formed (i.e., the black portions of FIG. 21A) are disposed in three locations, while regions in which the second recessed and projecting structure is formed (i.e., the white portions of FIG. 21A) are disposed in two locations. In the regions in which the first recessed and projecting structure is formed, two or more recessed parts and projecting parts are respectively formed, and two or more recessed parts and projecting parts are also formed in the regions in which the second recessed and projecting structure is formed. The recessed parts of the first recessed and projecting structure and the recessed parts of the second recessed and projecting structure are both grooves. These grooves are formed in a concentric circular or spiral configuration. Furthermore, as is shown in FIG. 21B, the width of the projecting parts of the first recessed and projecting structure and the width of the projecting parts of the second recessed and projecting structure are different, with the width of the projecting parts of the first recessed and projecting structure being greater than the width of the projecting parts of the second recessed and projecting structure.

EXAMPLE 4-2

FIGS. 22A and 22B illustrate the polishing body of this example. FIG. 22A is a plan view, and FIG. 22B is a sectional view of the portion indicated by line B–B' in FIG. 22A (furthermore, the sectional view indicates that there are two types of sections with different shapes; the positions of the sections do not accurately correspond to the positions of B and B').

The plan shape of the polishing body of the present example is a circular shape, and two types of recessed and projecting structures are formed in the surface of this polishing body. Here, the two types of recessed and projecting structures will be referred to respectively as the "first recessed and projecting structure" and the "second recessed and projecting structure". As is shown in FIG. 22A, regions which have the first recessed and projecting structure (i.e., the black portions of FIG. 22A) and regions which have the second recessed and projecting structure (i.e., the white portions of FIG. 22A) are disposed in the form of a lattice on the surface of the polishing body. In the regions in which the first recessed and projecting structure is formed, two or more recessed parts and projecting parts are respectively formed, and two or more recessed parts and projecting parts are also formed in the regions in which the second recessed and projecting structure is formed. The recessed parts of the first recessed and projecting structure and the recessed parts of the second recessed and projecting structure are both grooves. Within the respective regions, these grooves are formed in straight lines along the vertical direction in FIG. 22A. Furthermore, as is shown in FIG. 22B, the width of the projecting parts of the first recessed and projecting structure and the width of the projecting parts of the second recessed and projecting structure are different, with the width of the projecting parts of the first recessed and projecting structure being greater than the width of the projecting parts of the second recessed and projecting structure.

The polishing body of the above-mentioned Example 4-1 or Example 4-2 is mounted in a CMP apparatus of the type shown in FIG. 2, and is used in the polishing of silicon wafers, etc.

When pressure is applied to the polishing head on which the silicon wafer is held, so that the polishing head is pressed against the polishing body of Example 4-1 or Example 4-2 on the polishing platen at a specified pressure, the pressure per unit area that is applied to the polishing body is small in the regions where the width of the projecting parts of the recessed and projecting structure of the polishing body is large, so that the resulting amount of deformation of the polishing body is small. On the other hand, in the regions where the width of the projecting parts of the recessed and projecting structure of the polishing body is narrow, the pressure per unit area that is applied to the polishing body is large, so that the resulting amount of deformation of the polishing body is large. In other words, in apparent terms, a hard polishing body and a soft polishing body coexist in the same polishing body.

A soft polishing body, which has a small elastic modulus, is superior in terms of uniformity, while a hard polishing body, which has a large elastic modulus, is superior in terms of smoothness. This tendency also functions similarly in the polishing body of the present invention. Specifically, the portions of the polishing body in which the width of the projecting parts of the recessed and projecting structure is large function as the equivalent of a hard polishing body, so that the projecting parts of the recessed and projecting pattern on the silicon wafer are selectively polished during the polishing of the recessed and projecting pattern, thus improving the uniformity. On the other hand, the portions of the polishing body in which the width of the projecting parts of the recessed and projecting structure is narrow function as the equivalent of a soft polishing body, so that the polishing body performs polishing while conforming even to warping of the silicon wafer and irregularities in the film thickness produced during film formation, thus improving the smoothness.

EXAMPLE 4-3

Figures 23A, 23B:
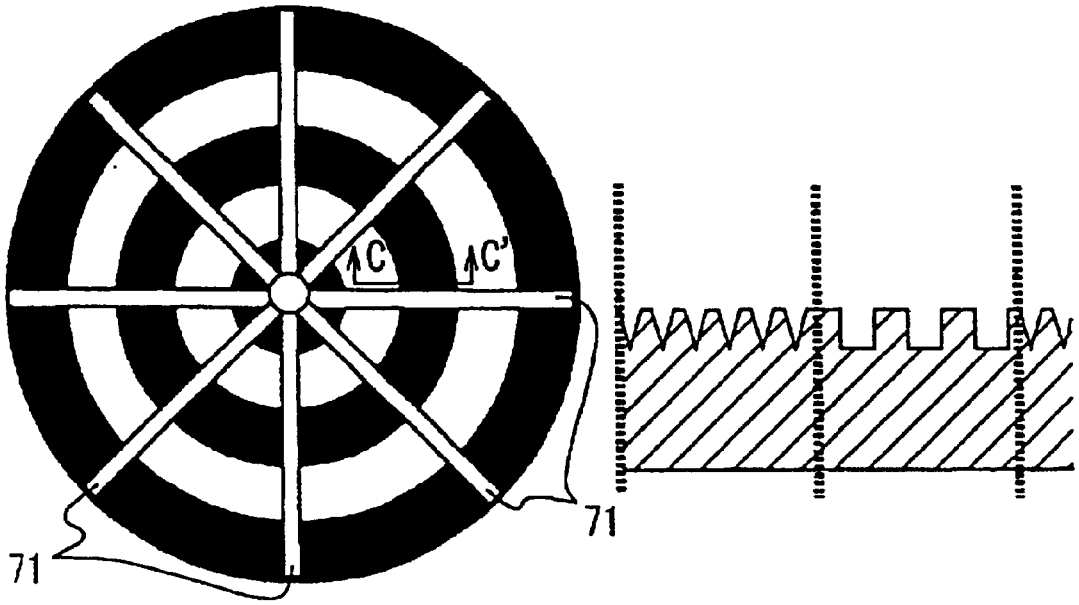
FIGS. 23A and 23B are diagrams which illustrates a polishing body constituting an example of the present invention.

FIGS. 23A and 23B illustrate the polishing body of the present example. FIG. 23A is a plan view, and FIG. 23B is a sectional view of the portion indicated by line C–C' in FIG. 23A (furthermore, the sectional view indicates that there are two types of sections with different shapes; the positions of the sections do not accurately correspond to the positions of C and C').

The polishing body of the present example is a modification of the polishing body of the above-mentioned Example 4-1. The portion of the polishing body of the present example that differs from the polishing body of the above-mentioned Example 4-1 is the portion in which grooves are formed in the surface of the polishing body in order to supply and discharge the polishing agent. As is shown in FIG. 23A, rectilinear grooves 71 are formed in a radial configuration from the center in order to supply and discharge the polishing agent. The remaining construction of this polishing body is the same as that of Example 4-1; accordingly, a description is omitted.

EXAMPLE 4-4

Figures 24A, 24B:
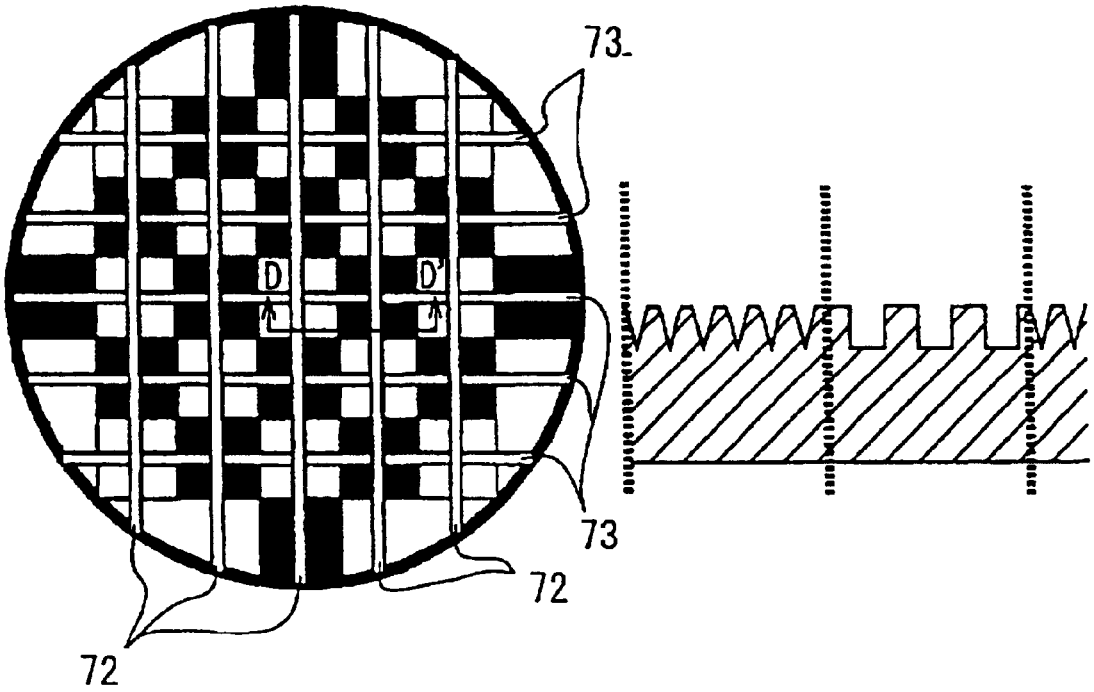
FIGS. 24A and 24B are diagrams which illustrates a polishing body constituting an example of the present invention.

FIGS. 24A and 24B illustrate the polishing body of the present example. FIG. 24A is a plan view, and FIG. 24B is a sectional view of the portion indicated by line D–D' in FIG. 24A (furthermore, the sectional view indicates that there are two types of sections with different shapes; the positions of the sections do not accurately correspond to the positions of D and D').

The polishing body of Example 4-4 of the present invention is a modification of the polishing body of the above-mentioned Example 4-2. The portion of the polishing body of the present example that differs from the polishing body of the above-mentioned Example 4-2 is the portion in which grooves are formed in the surface of the polishing body in order to supply and discharge the polishing agent. As is shown in FIG. 24A, rectilinear grooves 72 are formed in the longitudinal direction, and rectilinear grooves 73 are formed in the lateral direction, in order to supply and discharge the polishing agent. The remaining construction of this polishing body is the same as that of Example 4-2; accordingly, a description is omitted.

In the polishing of silicon wafers, it is desirable that the polishing agent be uniformly supplied to the entire surface of the silicon wafer. In cases where the polishing agent is not uniformly supplied, the uniformity deteriorates, and the friction increases, so that there may be cases in which the characteristics of the polishing apparatus deteriorate. It is sufficient if the grooves that supply and discharge the polishing agent in the polishing bodies of Example 4-3 and Example 4-4 solve the above-mentioned problems that occur during polishing; in regard to the groove width, groove shape and groove depth, there are no restrictions on the configuration used.

Furthermore, in the polishing bodies of Examples 4-1 through 4-4, two types of recessed and projecting structures were used; however, it would also be possible to use three or more types of recessed and projecting structures.

Furthermore, in the polishing bodies of the above-mentioned examples, the widths of the recessed parts and widths of the projecting parts were constant within regions in which recessed and projecting structures of the same type were formed; however, it would also be possible to use recessed and projecting structures in which the widths of the recessed parts and widths of the projecting parts vary in a given order.

Furthermore, Examples 4-1 and 4-3, the regions including the first recessed and projecting structure and the regions including the second recessed and projecting structure were disposed in the form of concentric circles, and in Examples 4-2 and 4-4, the regions including the first recessed and projecting structure and the regions including the second recessed and projecting structure were disposed in the form of a lattice; however, the regions including the first recessed and projecting structure and the regions including the second recessed and projecting structure could also be disposed in a periodic configuration or in some other configuration.

Furthermore, in the polishing bodies of Examples 4-1 through 4-4, the recessed parts of the first recessed and projecting structure and second recessed and projecting structure were grooves; however, these recessed parts could also be holes instead of grooves.

Furthermore, in the polishing bodies of these examples, the grooves constituting the recessed parts of the first recessed and projecting structure were rectangular, while the grooves constituting the recessed parts of the second recessed and projecting structure were V-shaped; however, the shapes of these grooves may be V-shaped, U-shaped, rectangular or trapezoidal.

Furthermore, the polishing bodies of these examples could also be applied in the case of polishing bodies which have a laminated structure with a layer that has a large elastic modulus. In such a case, the polishing body with a laminated structure is constructed from a first layer which has a recessed and projecting structure formed in the surface, and a second layer which is laminated on the undersurface of the first layer (i.e., on the opposite side from the surface); moreover, in order to obtain the effect of the present invention, it is desirable that the elastic modulus of the second layer be larger than the elastic modulus of the first layer.

Furthermore, the method used to form the grooves in the surface of the polishing body may be a universally known method; for example, a method in which the surface of the polishing body is milled using a groove working bit, etc. may be used.

Embodiment 4-1

A non-foam polishing body comprising an epoxy resin with the structure of Example 4-1 (FIG. 21A) was bonded to the polishing platen of a CMP apparatus. A recessed and projecting structure comprising V-shaped grooves with a depth of 0.3 mm and projecting parts with a width of 0.1 mm (i.e., the second recessed and projecting structure in FIG. 21B) and a recessed and projecting structure comprising recessed parts with a depth of 0.3 mm and a width of 5 mm and projecting parts with a width of 5 mm (i.e., the first recessed and projecting structure in FIG. 21B) were formed in a concentric circular configuration at a spacing of 20 mm in the surface of this polishing body. The angle of the inclined surfaces of the V-shaped grooves of the second recessed and projecting structure was approximately 60°.

The Vickers hardness of a non-foam polishing body comprising an epoxy resin is 7.0 (kgf/mm$^2$). In order to obtain a structure in which a soft polishing body and a hard polishing body coexist as described above, it is desirable that the Vickers hardness of the polishing body be 2.5 (kgf/mm$^2$) or greater, but no greater than 30 (kgf/mm$^2$). Furthermore, in the present embodiment, the width ratio of the portions in which the width of the projecting parts of the recessed and projecting structure was wide to the portions in which the width of the projecting parts of the recessed and projecting structure was narrow was 50. In order to obtain a structure in which a soft polishing body and a hard polishing body coexist as described above, it is desirable that the width ratio of the portions in which the width of the projecting parts of the recessed and projecting structure is wide to the portions in which the width of the projecting parts of the recessed and projecting structure is narrow be 2 or greater.

A six-inch silicon wafer on which a thermal oxidation film was formed to a thickness of 1 $\mu$m was attached to the polishing head via a backing material, and polishing was performed under the following conditions:

Polishing head rpm: 50 rpm

Polishing platen rpm: 50 rpm

Load (pressure pressing the polishing head against the polishing body): 400 g/cm$^2$ Oscillation width of polishing head: 30 mm Oscillation rate of polishing head: 15 strokes per minute Polishing time: 2 minutes Polishing agent used: SS 25 manufactured by Cabot Co., diluted 2X with ion exchange water Polishing agent flow rate: 200 ml/min Furthermore, in a six-inch silicon wafer on which a plurality of 2-mm square projecting patterns with a plurality of 500-nm step differences (film thickness of projecting parts: 1500 nm, film thickness of recessed parts: 1000 nm) were formed, the projecting parts were polished 500 nm by time control under the above-mentioned conditions.

Embodiment 4-2

A non-foam polishing body comprising an epoxy resin with the structure of Example 4-3 (FIG. 23A) was bonded to the polishing platen of a CMP apparatus. Radial grooves 71 with a width of 2 mm and a depth of 0.3 mm were formed beforehand in this polishing body in order to supply and discharge the polishing agent. Furthermore, a recessed and projecting structure comprising V-shaped grooves with a depth of 0.3 mm and projecting parts with a width of 0.1 mm (i.e., the second recessed and projecting structure in FIG. 23B) and a recessed and projecting structure comprising recessed parts with a depth of 0.3 mm and a width of 5 mm and projecting parts with a width of 5 mm (i.e., the first recessed and projecting structure in FIG. 23B) were formed in a concentric circular configuration at a spacing of 20 mm in the surface of this polishing body. The angle of the inclined surfaces of the V-shaped grooves of the second recessed and projecting structure was approximately 60°.

Using this polishing body, a six-inch silicon wafer on which a thermal oxidation film was formed to a thickness of 1 $\mu$m and a six-inch silicon wafer on which a plurality of 2-mm square projecting patterns with a plurality of 500-nm step differences were formed were polished in the same manner as in Embodiment 4-1.

Embodiment 4-3

A non-foam polishing body comprising an epoxy resin with the structure of Example 4-4 (FIG. 24A) was bonded to the polishing platen of a CMP apparatus. Lattice-form grooves 72 and 73 with a width of 2 mm and a depth of 0.3 mm were formed beforehand in this non-foam polishing body in order to supply and discharge the polishing agent. Furthermore, a recessed and projecting structure comprising V-shaped grooves with a depth of 0.3 mm and projecting parts with a width of 0.1 mm (i.e., the second recessed and projecting structure in FIG. 24B) and a recessed and projecting structure comprising recessed parts with a depth of 0.3 mm and a width of 5 mm and projecting parts with a width of 5 mm (i.e., the first recessed and projecting structure in FIG. 23B) were formed in a lattice-form configuration at a uniform spacing of 20 mm in the surface of this polishing body.

Using this polishing body, a six-inch silicon wafer on which a thermal oxidation film was formed to a thickness of 1 μm and a six-inch silicon wafer on which a plurality of 2-mm square projecting patterns with a plurality of 500-nm step differences were formed were polished in the same manner as in Embodiment 4-1.

COMPARATIVE EXAMPLE 4-1

A non-foam polishing body comprising an epoxy resin with a groove structure in its surface was bonded to the polishing platen of a CMP apparatus. V-shaped grooves with a projecting part width of 0.2 mm and a depth of 0.3 mm were formed in the surface of this polishing body at a spacing of 0.5 mm in order to hold the polishing agent. Furthermore, radial grooves with a width of 2 mm and a depth of 0.3 mm were formed in order to supply and discharge the polishing agent.

Using this polishing body, a six-inch silicon wafer on which a thermal oxidation film was formed to a thickness of 1 μm and a six-inch silicon wafer on which a plurality of 2-mm square projecting patterns with a plurality of 500-nm step differences were formed were polished in the same manner as in Embodiment 4-1.

COMPARATIVE EXAMPLE 4-2

A polishing body with a laminated structure comprising a laminate of a foam polishing body (first layer) with a groove structure in its surface, and an elastic body (second layer) with an extremely large elastic modulus, was bonded to the polishing platen of a CMP apparatus. V-shaped grooves with a projecting part width of 0.2 mm and a depth of 0.3 mm were formed in the surface of the first layer of this polishing body at a spacing of 0.5 mm in order to hold the polishing agent. Furthermore, radial grooves with a width of 2 mm and a depth of 0.3 mm were formed in order to supply and discharge the polishing agent.

Using this polishing body, a six-inch silicon wafer on which a thermal oxidation film was formed to a thickness of 1 μm and a six-inch silicon wafer on which a plurality of 2-mm square projecting patterns with a plurality of 500-nm step differences were formed were polished in the same manner as in Embodiment 4-1.

For Embodiments 4-1, 4-2 and 4-3, and Comparative Examples 4-1 and 4-2, the uniformity and smoothness were evaluated using respective silicon wafers after polishing was completed.

The uniformity was evaluated using the following formula by measuring the polishing amount profile of a six-inch silicon wafer on which a thermal oxidation film had been formed to a thickness of 1 μm (excluding a portion extending 5 mm inward from the edge of the wafer):

$$\text{Uniformity } (\%)=(RA-RI)/(RA+RI)\times 100$$

Here, RA is the maximum amount of polishing in the measured polishing amount profile, and RI is the minimum amount of polishing in the measured polishing amount profile.

Furthermore, the smoothness was evaluated as follows: using a six-inch silicon wafer on which a plurality of 2-mm square projecting patterns with a plurality of 500-nm step differences were formed, the step difference amount of 500 nm was polished away, and the residual step difference in this case was measured at a plurality of locations within the silicon wafer; then, the maximum value among the measured values of these residual step differences was taken as the smoothness.

The uniformity and smoothness evaluation results obtained for the above-mentioned embodiments and comparative examples are summarized in Table 2 (Embodiment 4-1 is indicated as Embodiment 1, and Comparative Example 4-1 is indicated as Comparative Example 1, etc.).

TABLE 2

| | Embodiment 1 | Embodiment 2 | Embodiment 3 | Comparative Example 1 | Comparative Example 2 |
|---|---|---|---|---|---|
| Uniformity (%) | 7 | 6 | 6 | 10 | 6 |
| Smoothness (nm) | 80 | 80 | 100 | 100 | 200 |

The above evaluations indicate that the poor uniformity or smoothness seen in Comparative Examples 4-1 and 4-2 was not seen in Embodiments 4-1, 4-2 and 4-3, in which both the uniformity and smoothness were superior.

Furthermore, when the uniformity was evaluated in Embodiment 4-2 and Comparative Example 4-1 with a portion extending 1 mm inward from the edge excluded, the value obtained in Embodiment 4-2 was 8%, while the value obtained in Comparative Example 4-1 was 20%. It is clear from these results that the polishing characteristics in the most peripheral portions of the silicon wafer are also sufficiently improved by the polishing body of the present invention.

Examples of Semiconductor Device Manufacturing Method

Figure 25:
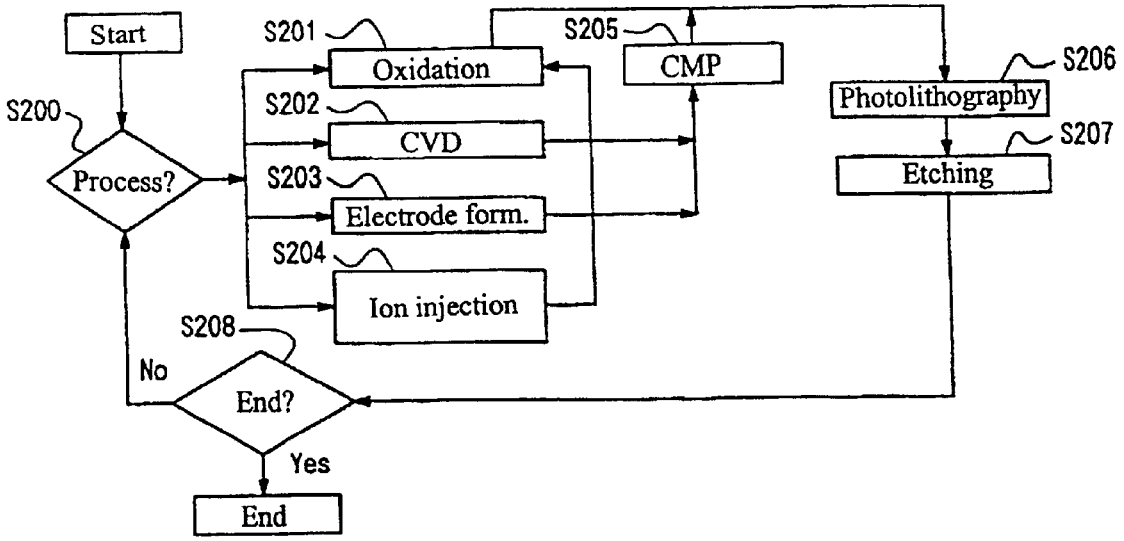
FIG. 25 is a flow chart which illustrates a semiconductor device manufacturing process.

FIG. 25 is a flow chart which illustrates the semiconductor device manufacturing process of the present invention. When the semiconductor device manufacturing process is started, an appropriate working process is first selected in step S200 from steps S201 through S204 described below. The processing then proceeds to one of the steps S201 through S204 in accordance with this selection.

Step S201 is an oxidation process in which the surface of the silicon wafer is oxidized. Step S202 is a CVD process in which an insulating film is formed on the surface of the silicon wafer by CVD, etc. Step S203 is an electrode formation process in which electrodes are formed on the silicon wafer by a process such as vacuum evaporation, etc. Step S204 is an ion injection process in which ions are injected into the silicon wafer.

Following the CVD process or electrode formation process, the work proceeds to step S205. Step S205 is a CMP process. In this CMP process, the smoothing of inter-layer insulation films or the formation of a damascene by the polishing of metal films on the surfaces of semiconductor devices, etc., is performed using the polishing apparatus of the present invention.

Following the CMP process or oxidation process, the work proceeds to step S206. Step S206 is a photolithographic process. In this photolithographic process, the silicon wafer is coated with a resist, a circuit pattern is burned onto the silicon wafer by exposure using an exposure apparatus, and the exposed wafer is developed. Furthermore, the next step S207 is an etching process in which the portions other than the developed resist image are removed by etching, and the resist is then stripped away, so that the resist that is unnecessary when etching is completed is removed.

Next, in step S208, a judgement is made as to whether or not all of the necessary processes have been completed; if these processes have not been completed, the work returns to step S200, and the previous steps are repeated, so that a circuit pattern is formed on the silicon wafer. If it is judged in step S208 that all of the processes have been completed, the work is ended.

Since the polishing apparatus and polishing method of the present invention are used in the CMP process in the semiconductor device manufacturing method of the present invention, semiconductor devices can be manufactured with a good precision, yield and throughput. As a result, semiconductor devices can be manufactured at a lower cost than in conventional semiconductor device manufacturing methods.

Furthermore, the polishing apparatus of the present invention can also be used in the CMP processes of semiconductor device manufacturing processes other than the above-mentioned semiconductor device manufacturing process.

As was described above, the use of the polishing body, polishing apparatus and polishing method of the present invention in a CMP process makes it possible to inhibit scratching of the object of polishing, increase the polishing rate and eliminate step differences. Moreover, stable polishing characteristics can be obtained. In addition, an object of polishing in which both the uniformity and smoothness are superior can be obtained. Furthermore, the semiconductor device manufacturing method of the present invention can be used to manufacture high-performance semiconductor devices with a good yield and throughput.

Figure 1A:
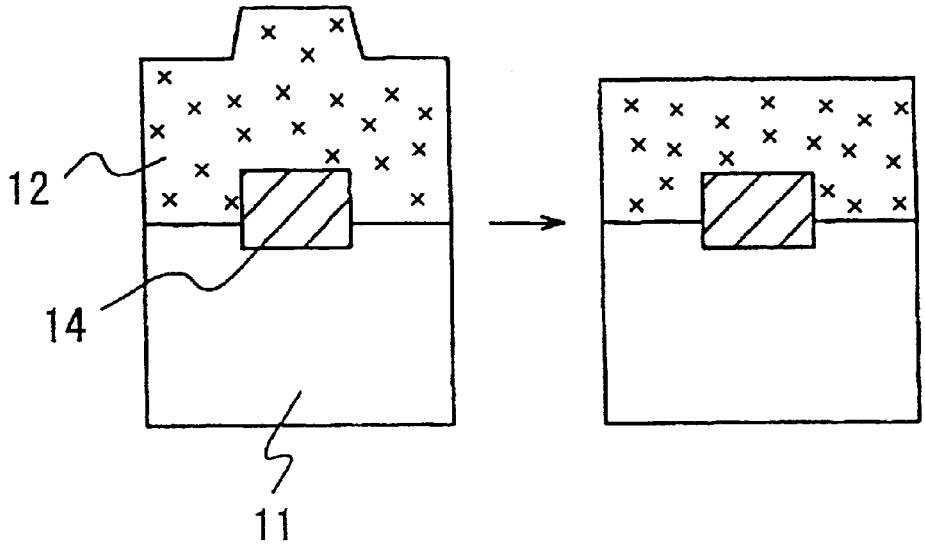
FIGS. 1A and 1B show schematic diagrams of planarization techniques used in semiconductor processes; these diagrams show sections of semiconductor devices.
Figure 1B:
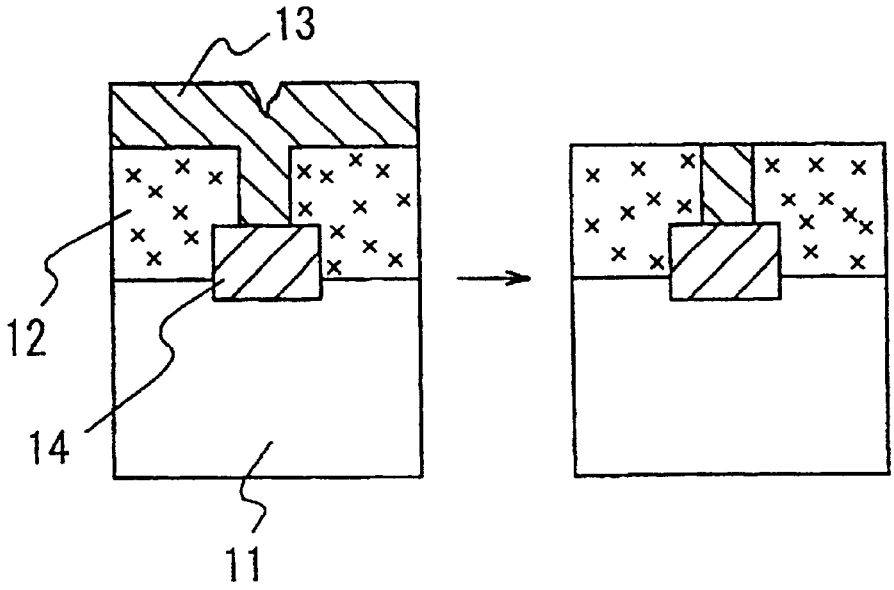

Furthermore, in the above description of the present invention, the polishing of wafers on which a pattern was formed as shown in FIG. 1 was described as an example. However, it goes without saying that the present invention could also be used for other purposes such as polishing for the purpose of smoothing bare silicon substrates, etc.

What is claimed is:

1. A polishing body used in a polishing apparatus in which an object of polishing is polished by causing relative motion between a polishing body and the object of polishing in a state in which a polishing agent is interposed between the polishing body and the object of polishing, wherein two or more different geometrically-shaped regions are formed in a surface of the polishing body, and recessed and projecting structures are formed in each said region, and further every projecting part in said region contacts to the object of polishing for contributing to the polishing.

2. The polishing body of claim 1, wherein at least two projecting parts are formed in every said region.

3. The polishing body of claim 2, wherein the recessed and projecting structures comprise a first recessed and projecting structure and a second recessed and projecting structure, wherein recessed parts of the first recessed and projecting structure and recessed parts of the second recessed and projecting structure are grooves, and a width of projecting parts of the first recessed and projecting structure is at least two times a width of projecting parts of the second recessed and projecting structure.

4. The polishing body of claim 1, wherein a plan shape of the polishing body is circular, and regions in which the recessed and projecting structures of the same geometrical shape are formed are disposed in a form of concentric circles.

5. A polishing apparatus in which an object of polishing is polished by causing relative motion between a polishing body and the object of polishing in a state in which a polishing agent is interposed between the polishing body and the object of polishing, wherein the polishing apparatus uses the polishing body of claim 4.

6. A semiconductor device manufacturing method including a process in which a wafer is polished using the polishing apparatus of claim 5.

7. The polishing body of claim 1, wherein regions in which the recessed and projecting structures of the same geometrical shape are formed are disposed in a lattice-form configuration.

8. The polishing body of claim 1, wherein grooves that supply and discharge the polishing agent are further formed in the surface of the polishing body.

9. The polishing body of claim 1, wherein a Vickers hardness k of the polishing body is such that 2.5 ($kgf/mm^2$) $<k<30$ ($kgf/mm^2$).

10. The polishing body of claim 1, wherein the polishing body is constructed from a first layer in the surface of which the recessed and projecting structures are formed, and a second layer which is disposed beneath the first layer and to which the first layer is laminated, and an elastic modulus of the second layer is greater than an elastic modulus of the first layer.

11. A polishing apparatus in which an object of polishing is polished by causing relative motion between a polishing body and the object of polishing in a state in which a polishing agent is interposed between the polishing body and the object of polishing, wherein the polishing apparatus uses the polishing body of claim 1.

12. A semiconductor device manufacturing method including a process in which a wafer is polished using the polishing apparatus of claim 11.

* * * * *